US008596314B2

(12) United States Patent
Py et al.

(10) Patent No.: US 8,596,314 B2
(45) Date of Patent: Dec. 3, 2013

(54) READY TO FEED CONTAINER WITH DRINKING DISPENSER AND SEALING MEMBER, AND RELATED METHOD

(75) Inventors: Daniel Py, Larchmont, NY (US); Julian Chan, New Milford, CT (US); Jeffrey Willey, Brookfield, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 1000 days.

(21) Appl. No.: 12/259,279

(22) Filed: Oct. 27, 2008

(65) Prior Publication Data

US 2009/0139949 A1 Jun. 4, 2009

Related U.S. Application Data

(60) Provisional application No. 60/983,153, filed on Oct. 26, 2007.

(51) Int. Cl.

| | |
|---|---|
| ***B65B 3/04*** | (2006.01) |
| ***A61J 9/00*** | (2006.01) |
| ***A61J 11/04*** | (2006.01) |
| ***B65D 25/40*** | (2006.01) |

(52) U.S. Cl.

USPC ..... 141/329; 215/11.1; 141/2; 141/82; 141/181; 53/373.7; 53/423; 220/703; 426/117; 426/300

(58) Field of Classification Search

USPC ..... 215/11.1, 11.4, 11.5, 227, 270, 387; 220/703, 714; 53/373.7, 423; 426/117, 426/399; 141/2, 18, 329, 330

See application file for complete search history.

(56) References Cited

U.S. PATENT DOCUMENTS

| | | | | |
|---|---|---|---|---|
| 2,619,088 | A | 11/1952 | Saffir | |
| 3,200,860 | A * | 8/1965 | Barton et al. | 141/330 |
| 3,334,764 | A * | 8/1967 | Fouser | 215/11.1 |
| 3,424,329 | A | 1/1969 | Hershberg et al. | |
| 3,532,242 | A * | 10/1970 | Tibbs | 215/11.1 |

(Continued)

FOREIGN PATENT DOCUMENTS

| | | |
|---|---|---|
| GB | 2 164 325 A | 3/1986 |
| GB | 2 185 889 A | 8/1987 |

(Continued)

OTHER PUBLICATIONS

International Search Report and Written Opinion of the International Searching Authority for International Application No. PCT/US2008/81393.

*Primary Examiner* — Sue A Weaver
(74) *Attorney, Agent, or Firm* — McCarter & English, LLP

(57) ABSTRACT

A container including a body defining an outflow opening and at least one chamber adapted for storing a product, such as a fat containing liquid product, and a container closure including a primary seal for hermetically sealing the product within the chamber during storage. The container closure includes a sealing member forming a substantially fluid-tight seal between the container closure and the body, and a dispensing member in fluid communication with the chamber. The container closure and body move relative to each other between a first position where the primary seal is seated about the outflow port to hermetically seal the product in the chamber during storage, and a second position where the primary seal is displaced from the outflow port to allow product to pass from the chamber through the outflow port and into dispensing member to dispense the product.

49 Claims, 18 Drawing Sheets

(56) References Cited

U.S. PATENT DOCUMENTS

| | | | | | |
|---|---|---|---|---|---|
| 3,586,196 | A | * | 6/1971 | Barton et al. | 215/11.6 |
| 3,645,262 | A | * | 2/1972 | Harrigan | 604/77 |
| 3,747,791 | A | * | 7/1973 | Fouser | 215/11.1 |
| 4,620,638 | A | * | 11/1986 | Schmidt | 215/11.1 |
| 4,676,387 | A | * | 6/1987 | Stephenson et al. | 215/11.1 |
| 4,821,895 | A | * | 4/1989 | Roskilly | 215/11.1 |
| 4,834,099 | A | * | 5/1989 | Schrooten | 215/11.1 |
| 4,867,325 | A | * | 9/1989 | Dransfield | 215/11.2 |
| 4,877,065 | A | | 10/1989 | Lamboy et al. | |
| 5,101,991 | A | | 4/1992 | Morifuji et al. | |
| 5,190,174 | A | * | 3/1993 | Klag | 215/11.1 |
| 5,275,298 | A | * | 1/1994 | Holley et al. | 215/11.4 |
| 5,419,445 | A | * | 5/1995 | Kaesemeyer | 215/11.1 |
| 5,433,328 | A | * | 7/1995 | Baron et al. | 215/11.4 |
| 5,747,083 | A | | 5/1998 | Raymond et al. | |
| 5,881,893 | A | | 3/1999 | Manganiello | |
| 5,950,689 | A | | 9/1999 | Varlet | |
| 6,098,795 | A | | 8/2000 | Mollstam et al. | |
| 6,257,428 | B1 | | 7/2001 | Caola | |
| 6,481,571 | B1 | | 11/2002 | Kelders et al. | |
| 6,499,615 | B1 | | 12/2002 | Szieff et al. | |
| 6,616,319 | B2 | | 9/2003 | Renz | |
| 6,920,991 | B2 | * | 7/2005 | Holley, Jr. | 215/6 |
| 6,971,551 | B2 | | 12/2005 | Widgery | |
| 7,780,023 | B2 | | 8/2010 | Py et al. | |
| 2002/0035997 | A1 | | 3/2002 | Shapira | |
| 2003/0071006 | A1 | * | 4/2003 | Kolb | 215/11.1 |
| 2004/0124168 | A1 | | 7/2004 | Silver | |
| 2005/0194341 | A1 | | 9/2005 | Houraney | |
| 2006/0137998 | A1 | | 6/2006 | Spector et al. | |
| 2008/0054001 | A1 | | 3/2008 | Roth et al. | |

FOREIGN PATENT DOCUMENTS

| | | | |
|---|---|---|---|
| RU | 2223902 | C2 | 2/2004 |
| WO | WO 03/101858 | A2 | 12/2003 |
| WO | WO 2007/120719 | A2 | 10/2007 |

* cited by examiner

READY TO FEED CONTAINER WITH DRINKING DISPENSER AND SEALING MEMBER, AND RELATED METHOD

CROSS REFERENCE TO PRIORITY AND RELATED APPLICATIONS

This patent application claims priority on U.S. Provisional Patent Application Ser. No. 60/983,153, filed Oct. 26, 2007, entitled "Ready to Feed Container with Drinking Dispenser and Sealing Member, and Related Method", which is hereby incorporated by reference in its entirety as part of the present disclosure. This patent application also discloses and claims subject matter similar to that disclosed and claimed in co-pending patent application entitled "Liquid Nutrition Product Dispenser with Plural Product Chambers for Separate Storage and Intermixing Prior to Use, and Related Method", filed on even date herewith, and associated with; and co-pending patent application entitled "Dispenser with Plural Product Chambers for Separate Storage and Intermixing of Products Prior to Use, and Related Method", filed on even date herewith, and associated with.

BACKGROUND INFORMATION

Drinking containers are used to store and dispense a variety of products. The containers are sterilized, filled, hermetically sealed, and then stored for consumer use. To seal the product within the container, thermoplastic elastomer ("TPE") seals are most often employed. One of the drawbacks of such TPE seals is that they can be difficult to use with fat containing liquid products, such as infant or baby formulas, or other milk-based or low acid products. For example, many such TPE materials contain leachables that can leach into the fat containing product, or otherwise can undesirably alter a taste profile of the product.

Another disadvantage of prior art drinking containers is that the TPE seals cover an undesirably large portion of the inner surface area where the product is stored, which increases the product's exposure to TPEs and further contributes to the difficulty in storing fat containing liquids products, such as infant or baby formulas, or other milk-based or low acid products.

A further drawback of prior art drinking containers, particularly containers for storing fat containing liquid products, such as infant or baby formulas, or other milk-based or low acid products, is that in order to drink or otherwise dispense the product, the screw cap or other type of closure must first be removed from the open mouth of the container. Then, the product is poured into a different container, such as a baby bottle having nipple, or a container closure having a nipple is screwed onto the open mouth of the container. These procedures not only can be inconvenient and time consuming, but can lead to spillage and/or contamination of the product.

Another drawback of prior art drinking containers and methods of filling such containers is that the containers may not provide the desired level of safety with respect to asepsis.

Another drawback of prior art drinking containers is that they do not offer the desired level of convenience with respect to the preparation and feeding, or provide a relatively simple intuitive functionality.

Another drawback of prior art drinking containers is that the containers may not provide the desired level of comfort to a feeding infant in comparison to natural breast feeding and can contribute to incidents of otitis, i.e. ear infections caused by fluid build-up in the middle ear attributed in some cases to negative pressures generated by the infant during bottle feeding and/or colic and, during tooth development, can contribute to orthodontic conditions such as tooth misalignments.

Another drawback of prior art drinking containers is that after the containers are filled and sterilized, the containers must be sealed and capped in separate stages, effectively reducing manufacturing throughput and increasing manufacturing costs.

Yet another drawback of prior art drinking containers is that is that once the containers are filled with product, the filled containers must undergo aseptic processing, such as retort sterilization, where heat is applied to the product, which in turn, can negatively affect the product formulation.

Accordingly, it is an object of the present invention to overcome one or more of the above-described drawbacks and disadvantages of the prior art.

SUMMARY OF THE INVENTION

In accordance with a first aspect, the present invention is directed to a container for storing and dispensing a product. The container comprises a body defining a chamber for storing the product, an outflow port in fluid communication with the chamber and a container closure. The container closure includes a primary seal, a secondary seal forming a substantially fluid-tight seal between the container closure and the body, and a dispensing member defining an outlet aperture connectible in fluid communication with the outflow port. At least one of the container closure and body is movable relative to the other between a first position where the primary seal is seated about the outflow port to hermetically seal the product in the chamber, and a second position where the primary seal is displaced from the outflow port to allow product to pass from the chamber through the outflow port and into the outlet aperture of the dispensing member to dispense product therethrough.

In another aspect of the invention, the container includes a portion that is penetrable by an injection or filling member, such as a needle, and the resulting injection aperture is thermally resealable, such as by application of laser energy thereto. In one such embodiment, the primary seal is penetrable by an injection member for aseptically filling the chamber with the product through the injection member, and is thermally resealable to seal the product within the chamber.

In another aspect of the invention, the container closure defines a vent aperture for improving flow of product between the chamber and outlet aperture when the container closure is in the second position. In one such embodiment, the container further comprises a sealing member that is movable between a first position sealing at least one of (i) the outlet aperture, (ii) the vent aperture and (iii) the outlet aperture and the vent aperture, and a second position opening at least one of (i) the outlet aperture, (ii) the vent aperture and (iii) the outlet aperture and the vent aperture.

In another aspect of the invention, the dispensing member is a nipple including a stem portion and a tip portion, wherein the outlet aperture extends through the stem portion and tip portion. In one such embodiment, the container defines an outer convexed surface, such that the nipple extends outwardly from the outer substantially convex surface, and the outer convex surface in combination with the nipple substantially replicates the shape and feel of a female breast.

In another aspect of the invention, the container comprises a frangible member, such as a breakaway tab, having an engaging position where the frangible portion engages a portion of the container closure and body after the container is filled with the product to prevent the container closure from moving out of the first position, and a disengaging position where the frangible member is removed from the container to allow the container closure to be moved between the first and second positions.

In some embodiments of the present invention, the product is a fat containing liquid product; the body does not leach more than a predetermined amount of leachables into the fat containing liquid product and does not undesirably alter a taste profile of the fat containing liquid product; the primary seal does not leach more than the predetermined amount of leachables into the fat containing liquid product or undesirably alter a taste profile of the fat containing liquid product; and the predetermined amount of leachables is less than about 100 PPM.

In accordance with another aspect, the present invention is directed to a method comprising the following steps:

(i) providing a container for storing and dispensing a product, the container comprising a body defining a sealed, empty chamber for storing the product and an outflow port in fluid communication with the chamber; and a container closure, the container closure including a primary seal, a secondary seal forming a substantially fluid-tight seal between the container closure and the body, and a dispensing member defining an outlet aperture in fluid communication with the outflow port, wherein at least one of the container closure and body is movable relative to the other between a first position where the primary seal is seated about the outflow port to hermetically seal the chamber during storage, and a second position where the primary seal is displaced from the outflow port to open the chamber;

(ii) providing an injection member in fluid communication with a source of the product;

(iii) at least one of (a) sterilizing the body and container closure, such as by applying gamma or ebeam radiation thereto, (b) molding the body and container closure with a sealed, empty, sterile chamber at the time of formation, and (c) assembling the body and closure upon molding, such as with one or both parts still in the mold or immediately upon removal from the mold under an overpressure of sterile gas, so that the assembled container defines a sealed, empty, sterile chamber;

(iv) introducing the injection member into fluid communication with the chamber;

(v) aseptically filling the chamber with the product through the injection member;

(vi) withdrawing the injection member from the chamber and resealing the chamber with respect to the ambient atmosphere; and (vii) aseptically storing the product in the sealed chamber with the primary seal in the first position to hermetically seal the product in the chamber with respect to the ambient atmosphere.

Some embodiments of the present invention further comprise moving at least one of the container closure and body relative to the other from the first position to the second position; placing the chamber in fluid communication with the dispensing member; and dispensing the product through the dispensing member.

Some embodiments of the present invention further comprise further providing a dispensing member in the form of a nipple; eccentrically locating the nipple on the closure; providing a vent laterally spaced relative to the nipple and in fluid communication with the chamber in the second position; and during dispensing, allowing air to vent through the vent while liquid flows through the nipple and substantially preventing air from flowing through the nipple One advantage of the present invention is that product is hermetically sealed when the container closure is attached to the container body and positioned such that the primary seal and/or stopper overlies the outlet port. Then, a user can move the container closure and/or container body relative to each other to unseal the product and drink directly from the stored container through the dispensing member that otherwise is sealed during storage and shelf-life of the container to maintain the aseptic condition of the product.

Other advantages of the present invention and/or of the currently preferred embodiments thereof will become readily apparent in view of the following detailed description of the currently preferred embodiments and accompanying drawings.

DETAILED DESCRIPTION OF THE INVENTION

Figure 2:
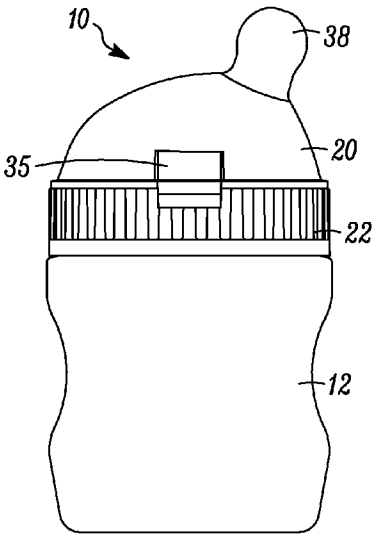
FIG. 2 is a side view of the container of FIG. 1.
Figure 3:
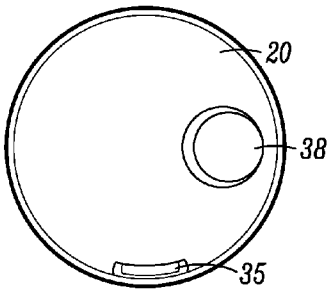
FIG. 3 is a top view of the container of FIG. 1.
Figure 1:
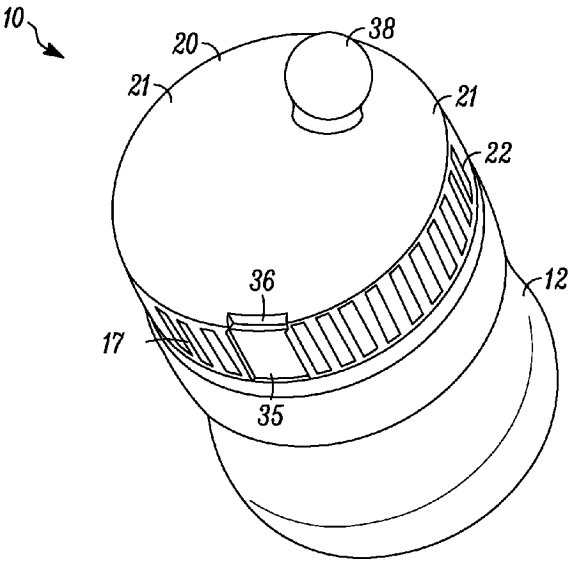
FIG. 1 is a top perspective view of a first embodiment of a container of the present invention.

In FIGS. 1-5, a container embodying the present invention is indicated generally by the reference numeral 10. The container 10 comprises a body 12 defining a chamber 14 for receiving a product or substance, and a container closure 20 including a peripheral gripping portion 22, and a sealing portion or secondary sealing member 26 (FIG. 4) extending about the periphery of the container closure and forming a substantially fluid-tight seal between the container closure and the body 12 to prevent leakage. The secondary sealing member 26 is received by at least one secondary annular groove 32 on the body 12 to effectuate the seal. In one embodiment, the secondary sealing member 26 is an elastomeric gasket; however, it should be noted that the secondary sealing member 26 can take on any of numerous forms and be made from any of numerous materials that are currently known, or that later become known, and are capable, for example, of forming a substantially fluid tight seal between the container closure 30 and container body 12. The container closure 20 further includes a securing portion or connecting flange 28 for movably securing the container closure 20 to the body 12 such that the container closure 20 and body are able to move relative to each other when secured together. In the illustrated embodiment, and by reference to FIGS. 4A and 7A-B, the container closure 20 and body 12 are snap fit together whereby the connecting flange 28 engages a primary annular groove 30 in the body 12; further, the container closure 20 and body rotate relative to each other. As may be recognized by those of ordinary skill in the pertinent art based on the teachings herein, the container closure 20 may be secured to the body 12 in any of numerous other ways that are currently known, or that later become known, such as by a threaded fit. For example, either the container closure or body can include one or more raised portions that are received within one or more recessed portions of the other for securing them together. Additionally, at least one of the container closure 20 and body 12 may move relative to the other in any of numerous other ways that are currently known, or that later become known, such as substantially vertically along the central or other axis "a" of the container 10. Once the container closure 20 is secured to the container 10, the chamber 14 is sealed forming an empty sealed chamber.

Figure 4A:
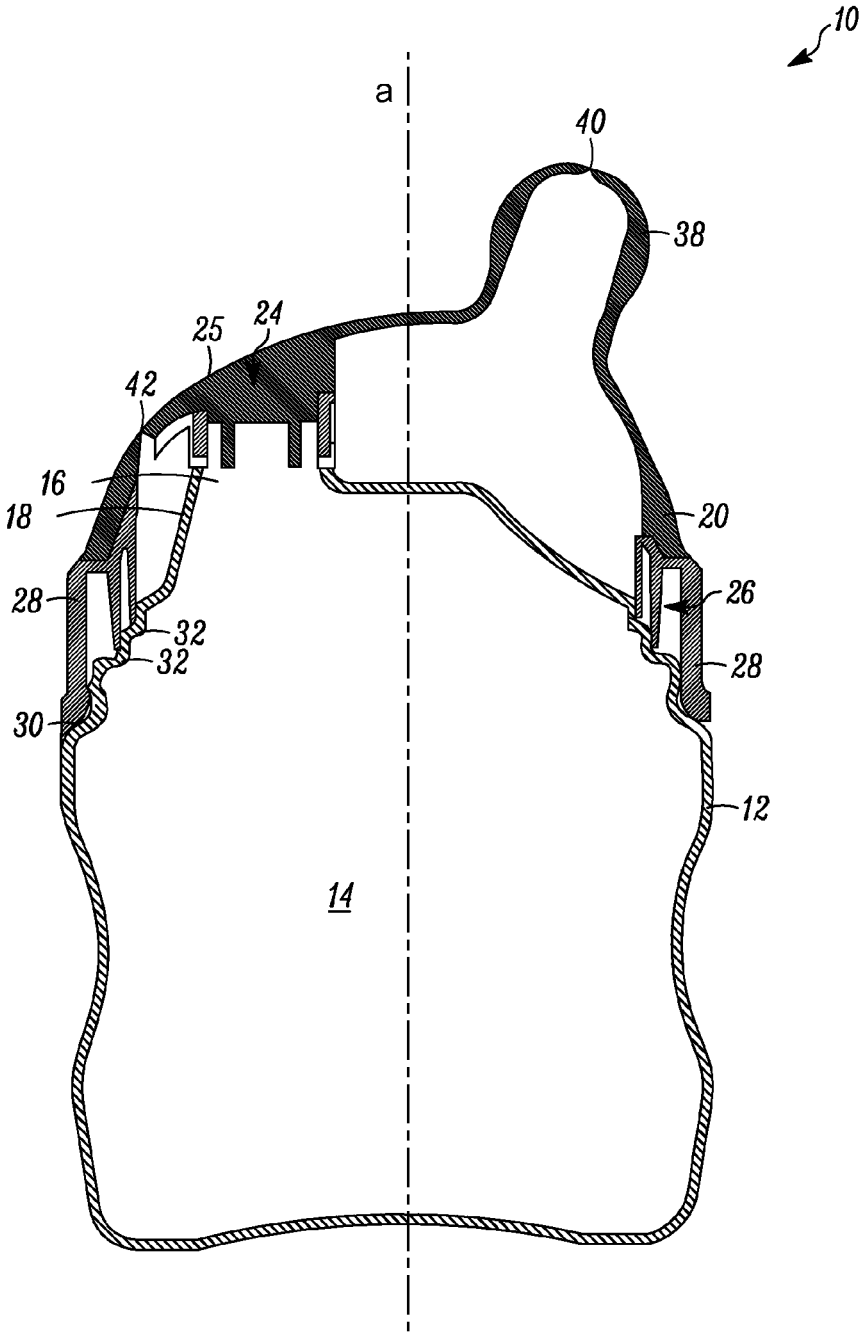
FIG. 4A is a cross-sectional view of the container of FIG. 1.
Figure 4B:
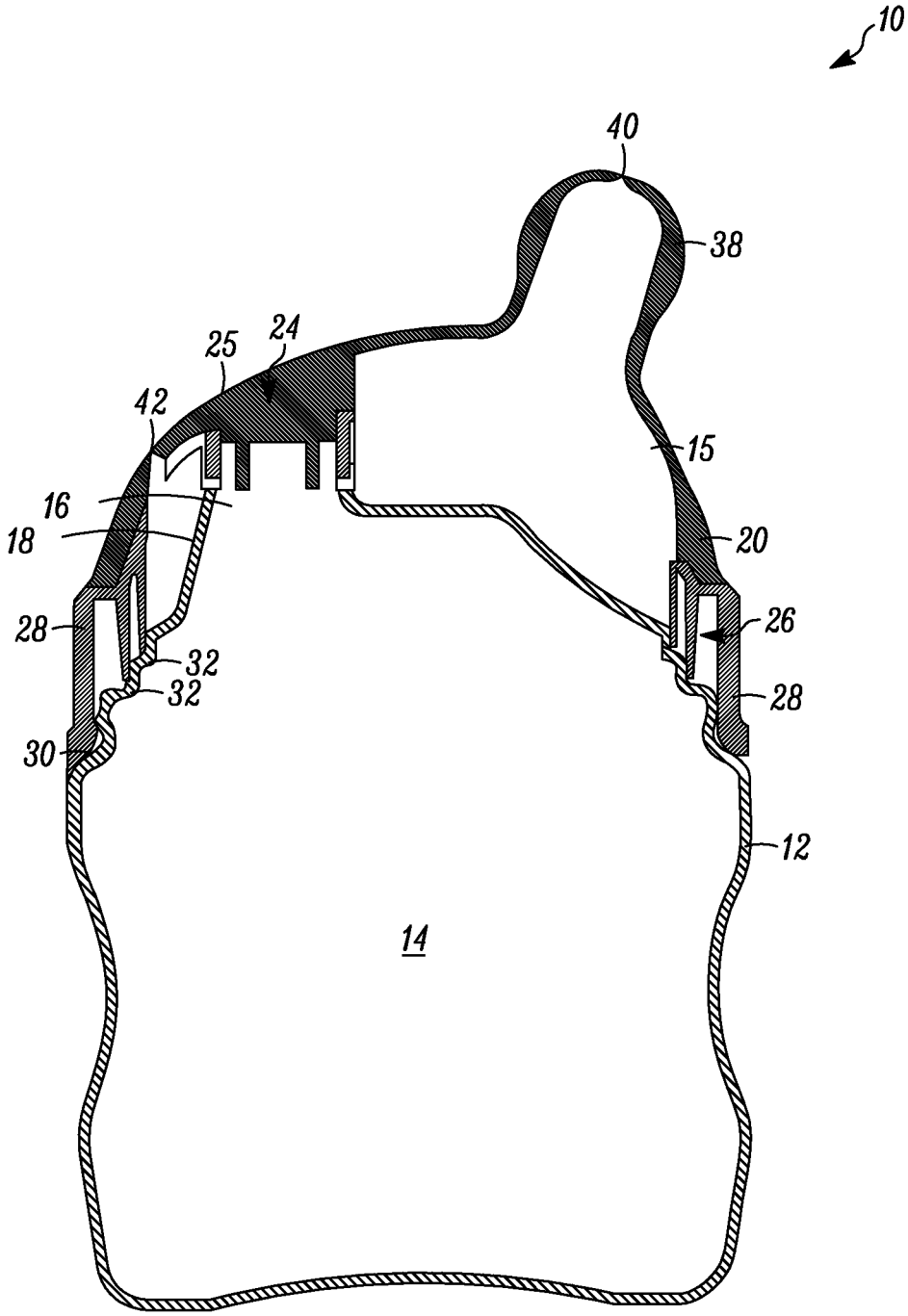
FIG. 4B is a cross-sectional view of the container if FIG. 1 showing an additional storage chamber.
Figure 5A:
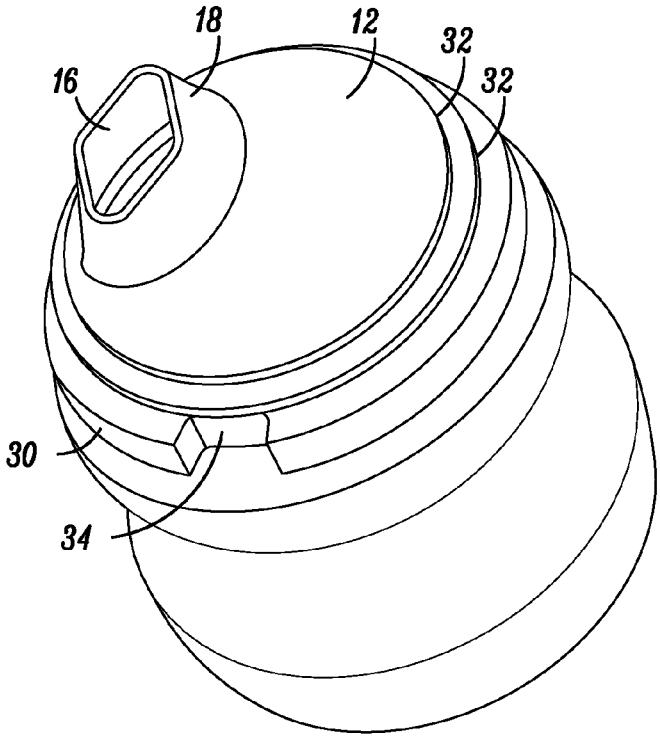
FIG. 5A is a top perspective view of the container of FIG. 1 with the container closure removed.
Figure 5B:
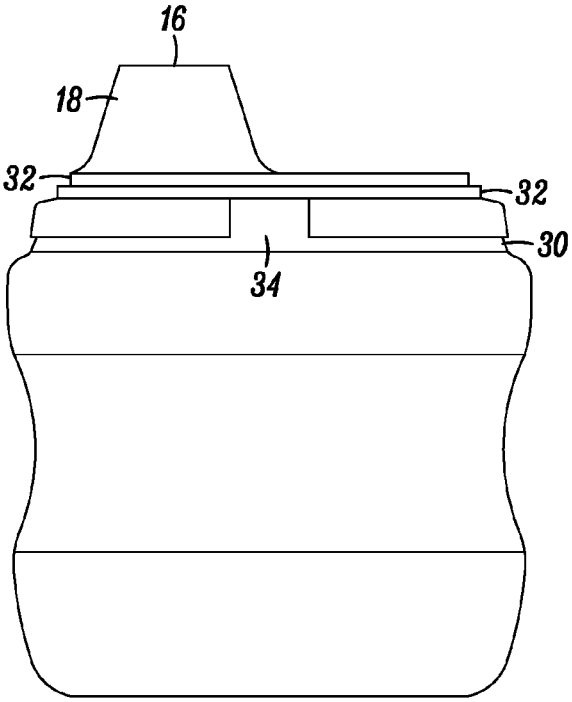
FIG. 5B is a side view of the container of FIG. 5A.

In addition, the container 10 may include any desired number of sealed empty chambers, including, for example, a first chamber 14 for receiving one or more first liquid components, and a second chamber 15 for receiving one or more second liquid components, as shown in FIG. 4B. In some such embodiments, the first and second chambers are initially sealed with respect to each other to maintain the first and second liquid components separate from each other during, for example, the shelf life of the product. Then, when the product is ready to be dispensed or used, the container includes a mechanism or feature to allow the first and second chambers to be placed in fluid communication with each other to allow mixing of the first and second liquid components at the time of use, or shortly before use.

The body 12 further defines an outflow port or opening 16 in fluid communication with the chamber 14. The outflow port 16 is typically circular, but can take on any shape or configuration; in one embodiment, the outflow port 16 has a raised periphery 18. A dispensing member 38 of the container closure 20 defines an outlet aperture 40 that is selectively connectable in fluid communication with the chamber 14 via the outflow port 16. The dispensing member 38 dispenses the product from the container 10 and can take on any of numerous different configurations that are currently known, or that later become known, such as a nipple (shown in the illustrated embodiment), a drinking spout (not shown), a drinking spout including a one-way check valve (not shown), wherein the check valve opens under negative pressure to allow the product to exit the outlet aperture, or a push-pull cap or sports bottle cap (not shown), wherein the outlet aperture is closed when the cap is in a retracted push position and the outlet aperture is open when the cap is in an extended pull position. As may be recognized by those of ordinary skill in the pertinent art based on the teachings herein, the dispensing member 38 can take on additional configurations that are currently known, or that later become known for dispensing products or substances from containers.

Figure 6B:
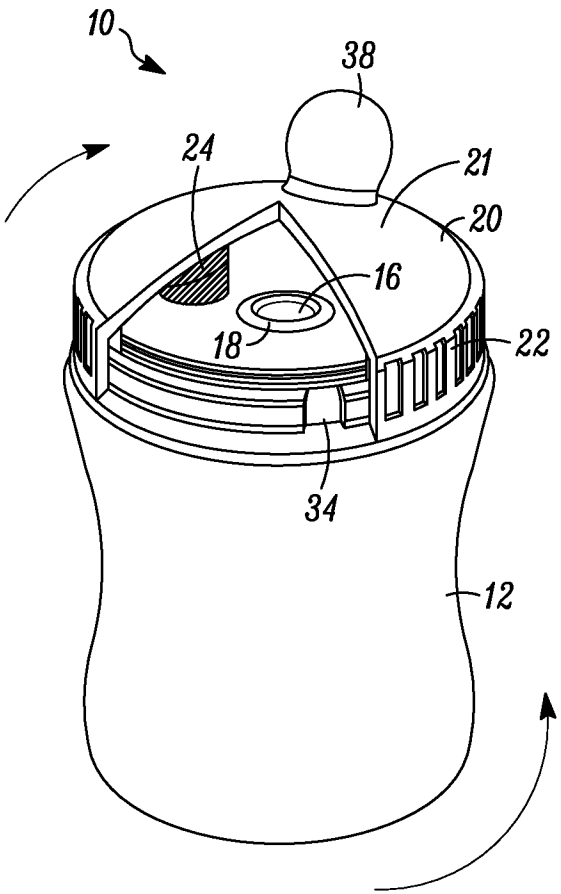
FIG. 6B is a side perspective view of the container of FIG. 1 with a portion of the container closure removed and showing the container closure in a second position.

To hermetically seal the product in the chamber 14 of the container 10, the container closure 20 employs a primary seal 24 or, in one embodiment, a stopper or septum, which is seated about and/or overlies the outflow port 16 when the closure is in the first position. As noted above, the container closure 20 is movable relative to the body 12 off the container. In the illustrated embodiment, the container closure 20 and body 12 rotate relative to each other along the longitudinal axis "a" of the container 10 between a first position (FIG. 6A) where the primary seal 24 is seated about the outflow port 16 to hermetically seal the outflow port and thus the product in the chamber 14 during storage, and a second position (FIG. 6B) where the primary seal is displaced from the outflow port to allow product to pass from the chamber 14, in the illustrated embodiment, through the outflow port 16 and into the outlet aperture 40 to dispense the product. In one embodiment, the hermetic seal is created by the application of positive pressure asserted by the container closure on the primary seal 24 when the primary seal is in the first position. However, it should be noted that the primary seal 24 can be configured and/or positioned about and/or within the outflow port 16 to create a hermetic seal without the application of positive pressure, for example, by way of an interference fit between the primary seal and outflow port. For ease of use, the movement of the container closure 20 and body 12 relative to each other is configured such that when the second position is achieved, the container closure 20 and body will remain in the second position to prevent the primary seal 24 from sealing the outflow port 16 until moved back into the first position if so desired. To improve the flow of the product from the chamber 14 through the outlet aperture 40 in the dispensing member 38, a vent aperture 42 is provided in the container closure 20 to place the closure chamber in fluid communication with the ambient atmosphere.

Figure 6A:
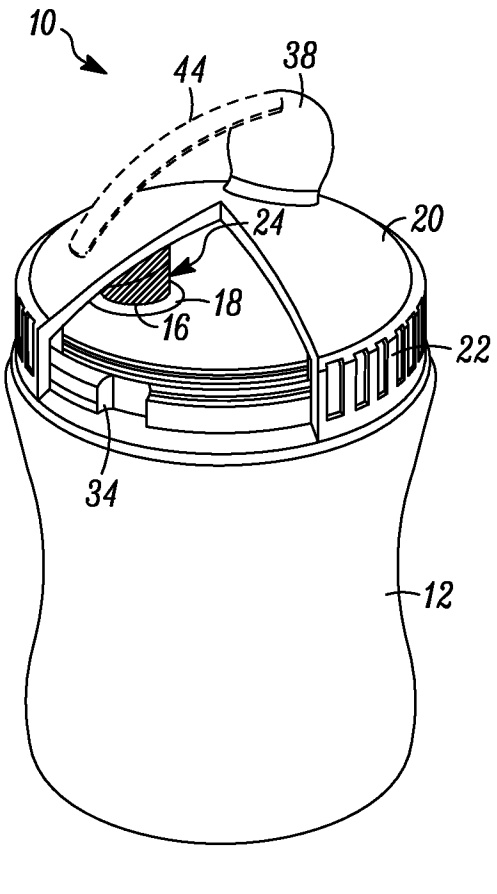
FIG. 6A is a side perspective view of the container of FIG. 1 with a portion of the container closure removed and showing the container closure in a first position.
Figure 9:
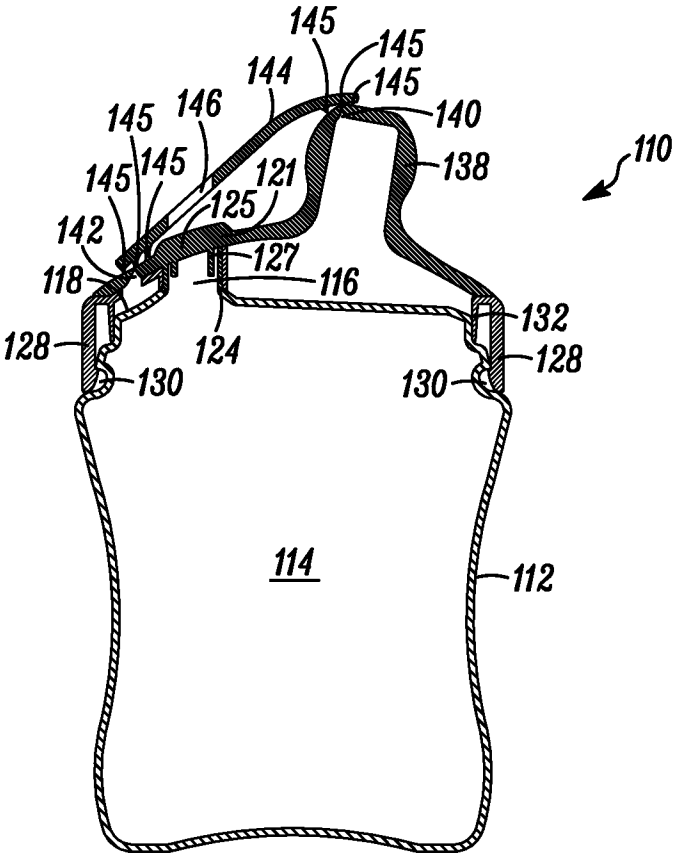
FIG. 9 is a cross-sectional view of the container of FIG. 8.
Figure 8:
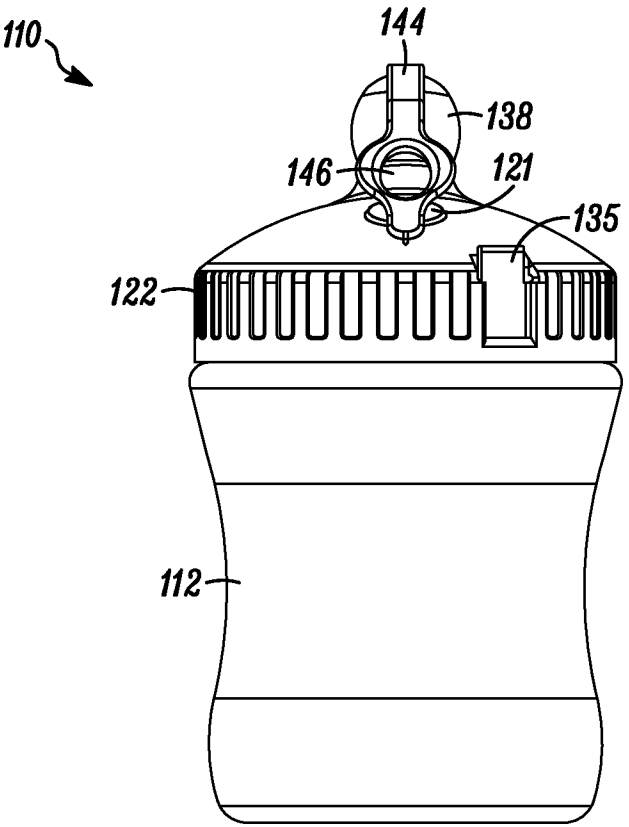
FIG. 8 is a front view of a second embodiment of a container of the present invention.

In an embodiment of the invention, and as shown in broken lines in FIG. 6A, the container closure 20 includes a sealing member 44 that is movable between a first position (FIG. 6A) sealing at least one of the dispensing member 38 and vent aperture 42, and a second (break away) position (FIG. 6B) opening at least one of the dispensing member 38 and vent aperture 42 to thereby allow product in the storage chamber 14 to be dispensed therethrough. In the illustrated embodiment, the sealing member 44 is connected to the dispensing member 38 and vent aperture 42 at least one frangible portion, and in one embodiment, three frangible portions (see, for example, sealing member 144 and frangible portions 146 of FIG. 9), which enables the user to break away the sealing member 144 with limited force, while at the same time requiring enough force to prevent accidental break away.

As can be seen, in the illustrated embodiment, the dispensing member 38 is a nipple positioned off center with respect to the central or longitudinal axis "a" of the container 10. Positioning the nipple in this manner is by itself, or in combination with the vent aperture 44, advantageous in decreasing incidents of otitis in bottle feeding infants and young children by reducing negative pressure generated during sucking, which in turn, reduces harmful fluid build-up in the inner ear. More specifically, as can be seen, the nipple 38 is positioned off center, and the elongated axis of the nipple is oriented at an acute angle relative the central, elongated or longitudinal axis "a" of the container. Preferably, the acute angle of the nipple relative to the longitudinal axis "a" of the container is within the range of about 10° to about 45°, and in the illustrated embodiment, the acute angle is about 28°. As can be seen, the overall length of the nipple, and the acute angle of the nipple, are such that the distal or free end of the nipple does not extend laterally outside the outer diameter of the closure. In addition, the vent aperture 42 is laterally spaced relative to the nipple 38, and in the illustrated embodiments, is located substantially on the diametrically opposite side of the closure relative to the nipple. One advantage of this configuration of the nipple and vent aperture is that during dispensing, an air pocket develops within the closure adjacent to the vent aperture 42 that substantially prevents any liquid from flowing into the vent aperture during dispensing, allows any air within the chamber to vent through the vent aperture, and substantially prevents the air from venting through the nipple and otherwise causing, for example, a baby to suck air through the nipple. Accordingly, the eccentrically mounted nipple, and the vent aperture laterally spaced from the nipple, substantially prevents the formation of a vacuum within the nipple, the fluid dispensed through the nipple, or within the mouth of a baby sucking on the nipple. Further, because of the laterally spaced location of the vent aperture, the liquid does not block the vent aperture during dispensing, and thus does not give rise to undesirable cavitations within the nipple, the liquid or the mouth of a baby sucking on the nipple. As can be seen, the secondary sealing member 26 and nipple 38 are formed integral with each other from a first material, while the primary seal 24 is formed of a second material different than the first material. As may be recognized by those of ordinary skill in the pertinent art based on the teachings herein, the primary seal 24, nipple 38 and secondary sealing member 26 can be formed of the same material, and/or can be formed integral with each other, such as by co-molding.

Figure 18B:
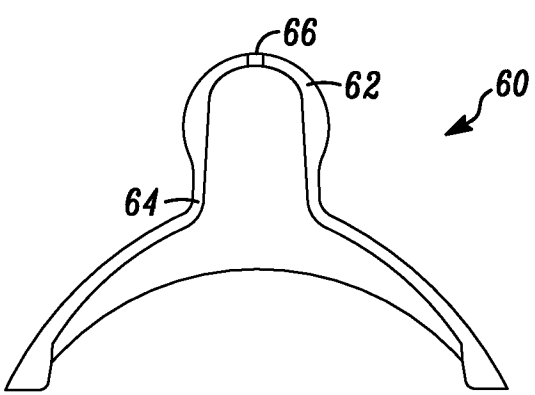
FIGS. 18A-F are side perspective and cross-sectional views of nipple variations.
Figure 18C:
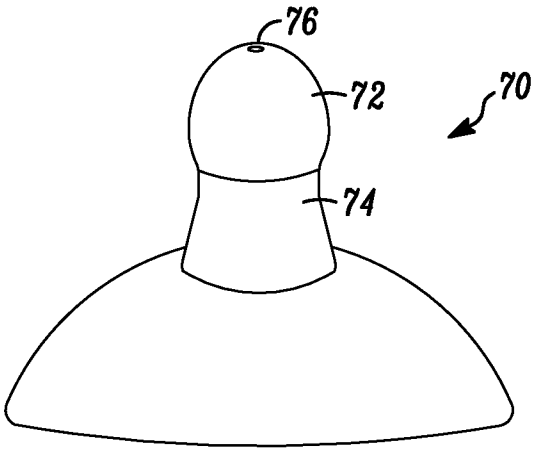
Figure 18A:
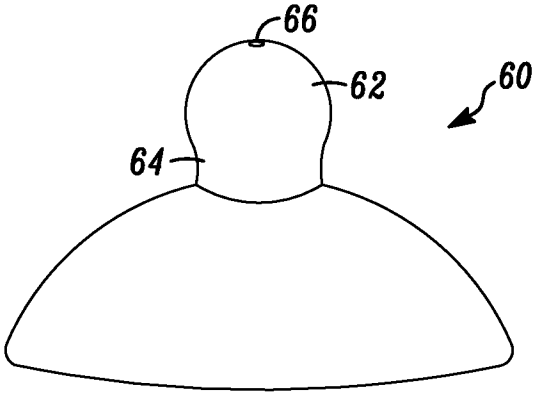
Figure 18E:
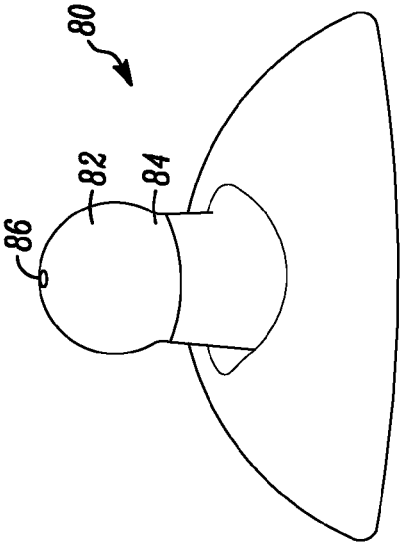
Figure 18F:
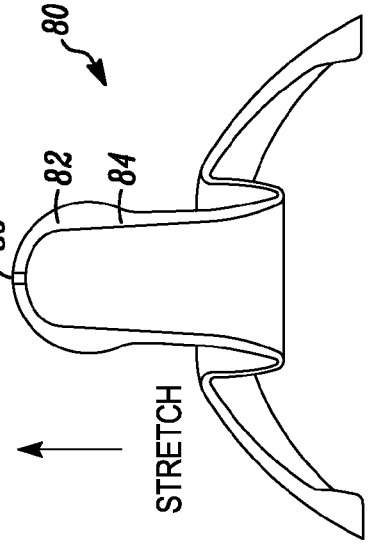
Figure 18D:
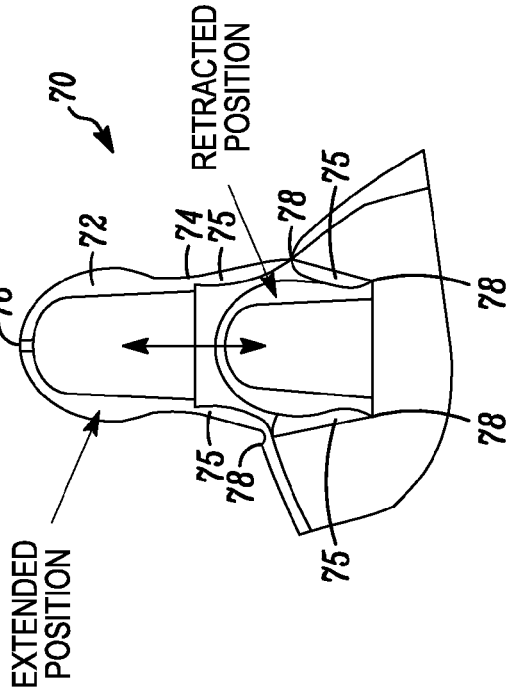

Referring to FIGS. 18A-F, various nipple configurations are shown, all of which represent different embodiments of the dispensing member 38. In FIGS. 18A-B, a round nipple 60 having an approximately round shaped tip 62 and a generally cylindrical stem 64 is shown. The nipple 60 is maintained in a single position during both storage and use. In FIGS. 18C-D, a second nipple configuration is shown. In this configuration, the nipple 70 has an approximately oval shaped tip 72 and a partially tapered generally cylindrical stem 74. The nipple 70 is a bi-stable nipple movable between two positions: a retracted position, wherein the nipple 70 remains at least partially retracted within the closure 20 during storage and/or non-use, and an extended position (or ready to feed position) wherein the nipple remains at least partially extended during use for dispensing the product. In the retracted position, a portion 75 of the stem 74 is inverted and self-stabilizing, allowing the nipple 70 to remain in the retracted position until the user engages the nipple and moves the nipple into the extended position. In the extended position, the portion 75 of the stem 74 is brought to a non-inverted position and, is again, self-stabilizing, allowing the nipple 70 to remain in the extended position until the user engages the nipple and moves the nipple into the retracted position if so desired. The nipple 70 defines at least one flex joint 78 which allows the nipple 70 to move between the two positions. In FIGS. 18E-F, a third nipple configuration is shown. In this configuration, the nipple 80 has an approximately round shaped tip 82 and a partially tapered generally cylindrical stem 84. The nipple 80 is a stretchable nipple that can be stretched between a recessed position, wherein the nipple 80 remains at least partially recessed within the closure 20 during storage and/or non-use, and an extended or stretched position wherein the nipple extends from the outer surface 21 of the container closure. The nipple 80 can dispense product in any position; i.e. whether the nipple is partially recessed, fully or partially stretched or any position therebetween. Each of the above-described nipples 60, 70, 80 defines a respective outlet aperture 66, 76, 86 for dispensing product therethrough and is in fluid communication with storage chamber 14 (FIG. 4A) or at least one of the storage chambers 14, 15 if multiple storage chambers are present (FIG. 4B). It should be noted that the shapes, profiles and sizes of the nipples 60, 70, 80 including the tips 62, 72, 82 and stems 64, 74, 84 can take on any of numerous shapes, profiles, sizes and combinations thereof that are currently known, or that later become known; for example, the nipple 60 can have a substantially oval-shaped tip 62 and a somewhat tapered stem 64, the nipple 70 can have a substantially round tip 72 and a generally cylindrical, non-tapered stem 74, etc. to customize the nipple for the comfort of the child.

In a currently preferred embodiment of the present invention, the product contained within the storage chamber 14 is a fat containing liquid product. The fat containing liquid product may be any of numerous different products that are currently known, or that later become known, including without limitation infant or baby formulas, growing-up milks, milks, creams, half-and-halfs, yogurts, ice creams, juices, syrups, condiments, milk-based or milk-containing products, liquid nutrition products, liquid health care products, and pharmaceutical products. As can be seen in FIG. 4 and FIG. 6A, the primary seal 24 (second material portion) defines an internal surface in fluid communication with the chamber 14 at the outflow port 16 and forms at least most of the surface area of the container closure 20 that can contact any fat containing liquid product within the chamber 14, and that does not leach more than a predetermined amount of leachables into the fat containing liquid product or undesirably alter a taste profile of the fat containing liquid product.

The term "leachable" is used herein to mean any chemical compound (volatile or non-volatile) that leaches into the product within the container from a component of the container during the period of storage through expiry of the product. An exemplary leachable to be avoided in connection with fat containing liquid nutrition products, such as infant or baby formulas, is mineral oil. Accordingly, as indicated below, in the exemplary embodiments of the present invention, the container body and container closure are not made from materials containing mineral oil, or that contain sufficiently low amounts of mineral oil such that they do not leach mineral oil into the fat containing liquid nutrition product, or substantially do not leach mineral oil into the fat containing liquid nutrition product (i.e., if any mineral oil is leached into the product, any such amount is below the maximum amount permitted under applicable regulatory guidelines for the respective product, such as FDA or LFCA guidelines). In accordance with the currently preferred embodiments of the present invention, the primary seal does not leach more than a predetermined amount of leachables into the product. The predetermined amount of leachables is less than about 100 PPM, is preferably less than or equal to about 50 PPM, and most preferably is less than or equal to about 10 PPM.

Figure 7B:
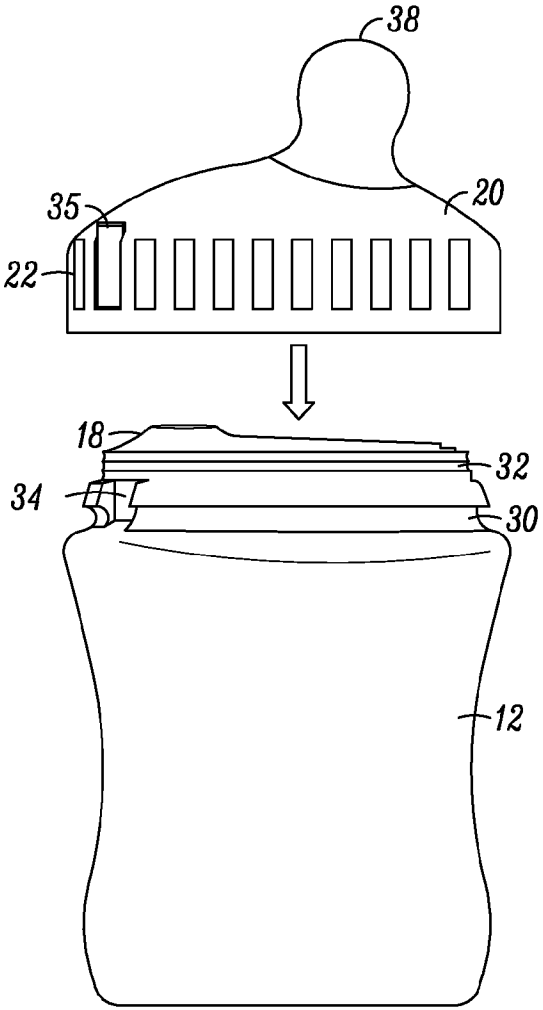
FIG. 7B is an exploded, side view of the container of FIG. 1.
Figure 7A:
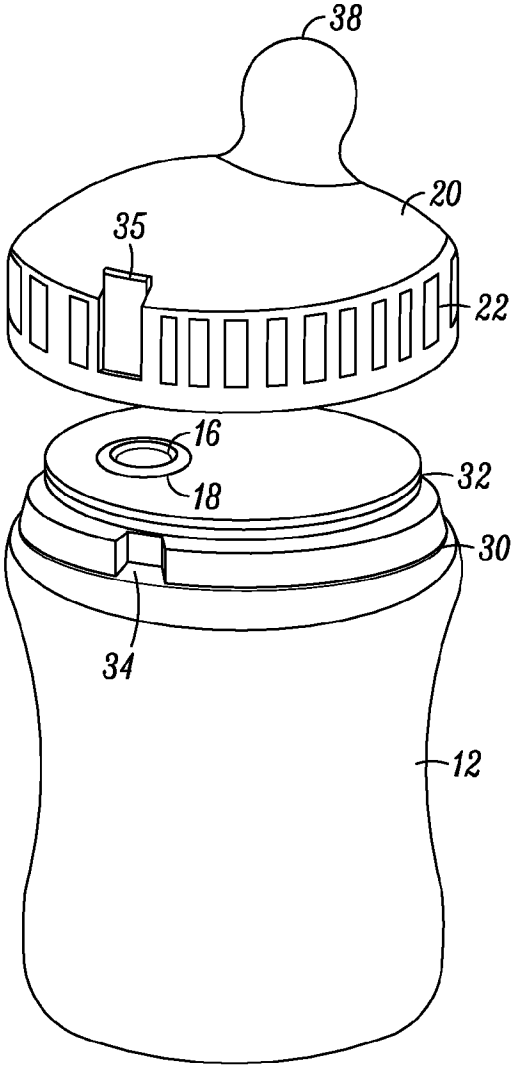
FIG. 7A is an exploded, side perspective view of the container of FIG. 1.

Drawing attention to FIGS. 7A-B, an exploded view of an embodiment of the container 10 is shown. In the illustrated embodiment, the body 12 is made from a blow molded polymer, such as polyethylene or polypropylene; however, it should be noted that the body 12 can be made from any of numerous different materials that are currently known, or that later become known, such as, for example, additional polymeric materials, metals, composites, or combinations thereof. In addition to the outflow port 16, the primary annular groove 30 and the secondary annular groove(s) 32, the body 12 defines a first tab recess 34 for receiving a breakaway tab 35, which is described in further detail below. The container closure 20 includes a co-molded outer portion, such as by insert molding, that comprises the gripping portion 22, a second tab recess 36, the break away tab 35 and the securing portion or connecting flange 28. The break away tab 35 is frangibly secured to the container closure in the second tab recess 36. The dispensing member 38, particularly in embodiments where a nipple is used, is co-molded, such as by over molding, to one or both of the primary and secondary seals. To fill the container 10, conventional sterilizing methods can be used whereby the body 12 and container closure 20 (and all other components associated with the container 10) are sterilized with heat, radiation, such as gamma or e-beam, and/or chemicals, such as fluid sterilants like vaporized hydrogen peroxide ("VHP"). If filled conventionally, a filling member such as a nozzle (not shown) is inserted through the outflow port 16 and the chamber 14 is filled with the desired amount of product or substance. The filling member is then removed and an additional sterilizing step is employed if required. Then, the container closure 20 is aligned and snap fit to the body 12 such that the breakaway tab 35 is received by the first tab recess 34, which locks the container closure in the first position relative to the body 12. In this assembled configuration, the primary seal 24 is positioned about the outflow port 16 (as noted above) such that the product in the chamber 14 is hermetically sealed. Additionally, the primary sealing member can be co-molded with the container closure.

If desired, the container closure may be molded in the same mold as the container body, or may be molded in adjacent molding machines, and at least one of the container closure and the body may be assembled within or adjacent to the mold in accordance with the teachings of U.S. Patent Application No. 60/551,565, filed Mar. 8, 2004, entitled "Apparatus and Method for Molding and Assembling Containers with Stoppers and Filling same"; U.S. patent application Ser. No. 11/074,454, filed Mar. 7, 2005, entitled "Method for Molding and Assembling Containers with Stoppers and Filling same"; U.S. patent application Ser. No. 11/074,513, filed Mar. 7, 2005, entitled Apparatus for Molding and Assembling Containers with Stoppers and Filling same; U.S. Patent Application Ser. No. 60/727,899 filed Oct. 17, 2005, entitled "Sterile De-Molding Apparatus And Method"; and U.S. patent application Ser. No. 11/582,291, filed Oct. 17, 2006, entitled "Sterile De-molding Apparatus and Method", each of which is hereby expressly incorporated by reference as part of the present disclosure. Alternatively, the closure and body may be co-molded by blow molding, such as by co-extrusion blow molding, wherein the molding process results in a sealed empty container defining one or more sterile chambers therein ready for aseptic filling, such as by needle filling and laser resealing, as disclosed in the following co-pending patent applications, which are hereby incorporated by reference in their entireties as part of the present disclosure: U.S. Application Ser. No. 61/104,649, filed Oct. 10, 2008, entitled "Co-Extrusion Blow Molding Apparatus and Method, and Sealed Empty Devices"; and U.S. Application Ser. No. 61/104,613, filed Oct. 10, 2008, entitled "Device with Co-Extruded Body and Flexible Inner Bladder and Related Apparatus and Method. One advantage of the devices, apparatus and methods disclosed in these patent applications is that the container is closed to define a sealed, empty sterile chamber at essentially the time of formation, and the container is never opened (through filling, resealing, and during shelf life) until the product is dispensed. Accordingly, a significantly high level of sterility assurance can be achieved. Alternatively, as described above, the sealed empty containers may be sterilized in any of numerous different ways that are currently known, or that later become known, such as by applying radiation, such as beta or gamma radiation, or by applying a fluid sterilant thereto, such as VHP.

In operation, in order to drink the product from the container 10, the user manually removes the sealing member 44 (if so equipped), which opens outlet aperture 40 of the dispensing member 38 and vent aperture 42, and then the breakaway tab 35, which unlocks the container closure 20. Next, while manually engaging the gripping portion 22 of the container closure 20 and a portion of the body 12, the user moves or, in the illustrated embodiment, rotates the container closure 20 relative to the body 12 from the first position where the primary seal 24 is seated about the outflow port 16 (outflow port closed and product hermetically sealed in chamber 14) to the second position where the primary seal 24 is displaced from the outflow port 16 (outflow port opened and product ready for dispensing) to allow product to pass from the chamber 14 through the outflow port 16 and into the outlet aperture 40 of the dispensing member 38 to dispense the product. It should be noted that in the illustrated embodiment, there are at least three options that that the user can employ to move the primary seal 24 from the first position to the second position to open the outflow port 16: (i) the user can grasp the body 12 to prevent movement thereof and rotate the container closure 20 in a first direction relative to the body 12; (ii) the user can grasp the container closure 20 to prevent movement thereof and rotate the body 12 in a second direction opposite the first direction relative to the container closure 20; (iii) the user can grasp both the container closure 20 and body 12 and simultaneously rotate the container closure 20 in the first direction and the body 12 in the second direction; or (iv) any combination thereof. As may be recognized by those of ordinary skill in the pertinent art based on the teachings herein, the design of the container closure 20 and/or body 12 is not limited to rotational movements, but rather can involve alternative movement configurations that are currently known, or that later become known capable of displacing the primary seal 24 from the first position to the second position. For example, the container closure 20 and/or body 12 can be moved in a linear or substantially vertical direction relative to each other.

Figure 15B:
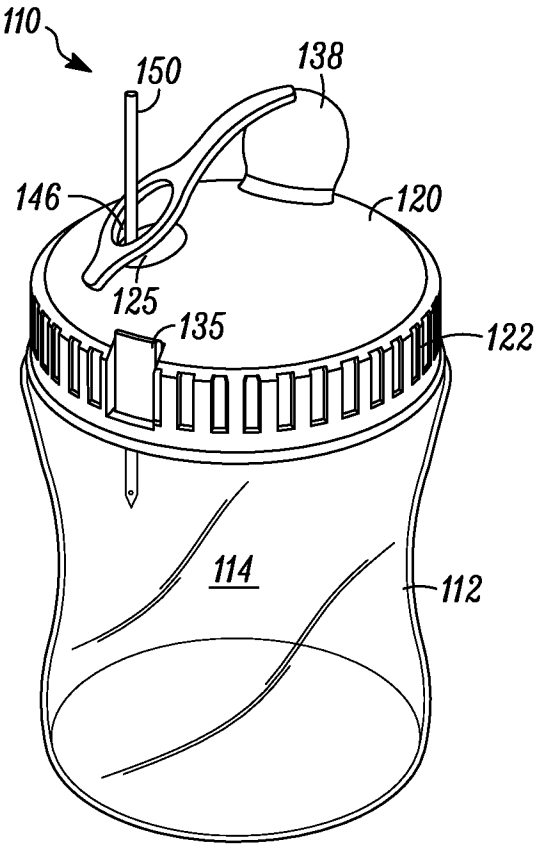
FIGS. 15A-C are top-side perspective views of the container of FIG. 8 during the filling stages.
Figure 15A:
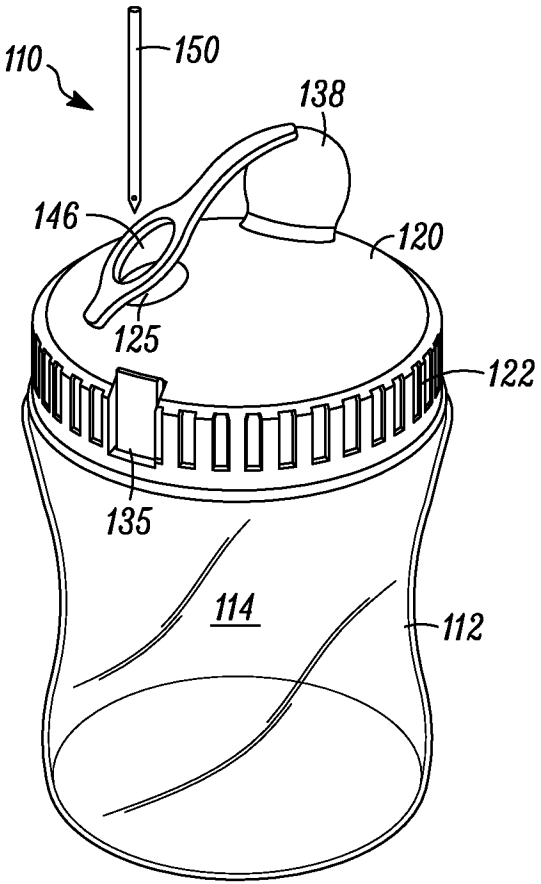
Figure 16A:
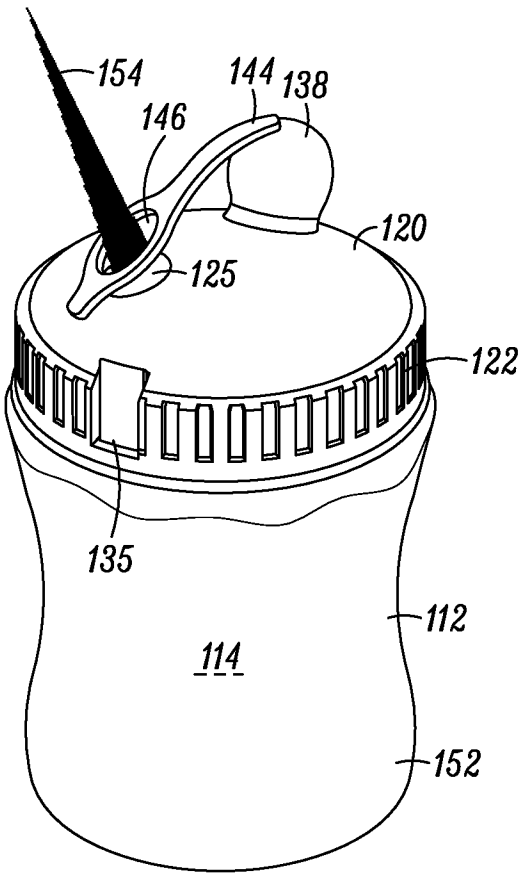
FIGS. 16A-B are top-side perspective views of the container of FIG. 8 during the laser resealing stages.
Figure 15C:
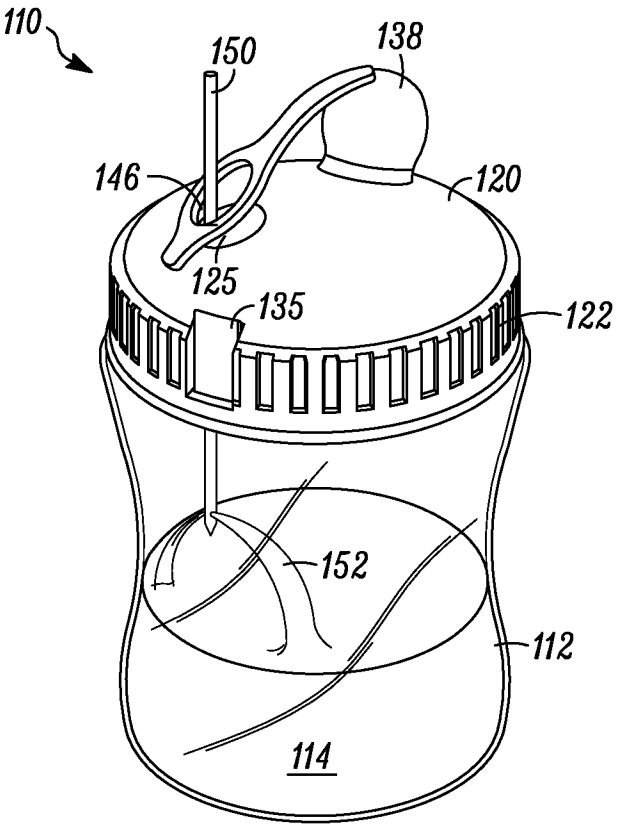
Figure 16B:
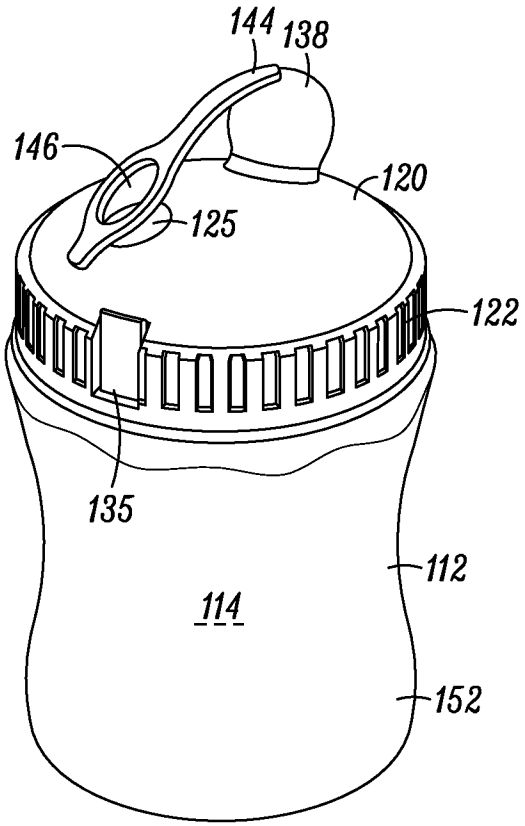
Figures 17A, 17B, 17C:
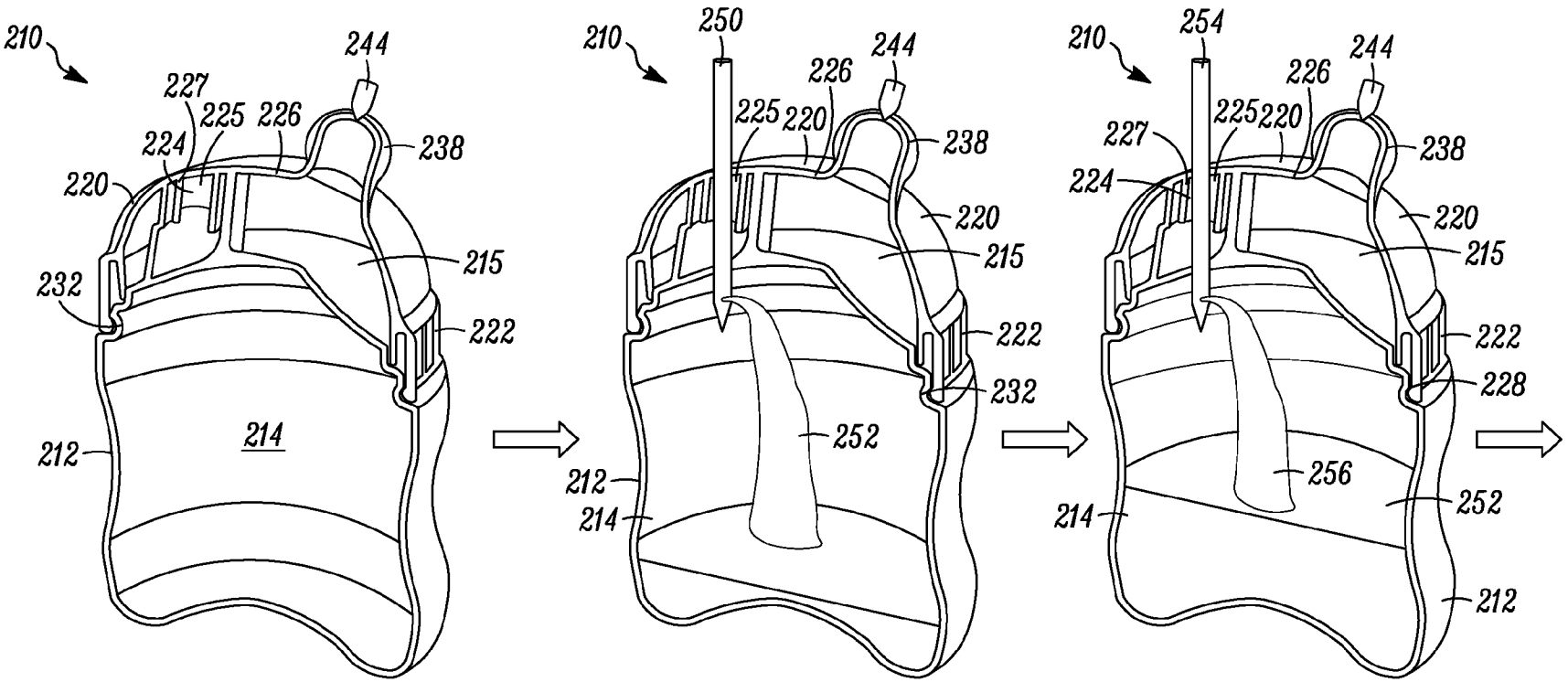
FIGS. 17A-F is a somewhat schematic illustration of an example of a method of filling, sealing and opening the containers of the present invention.
Figures 17D, 17E, 17F:
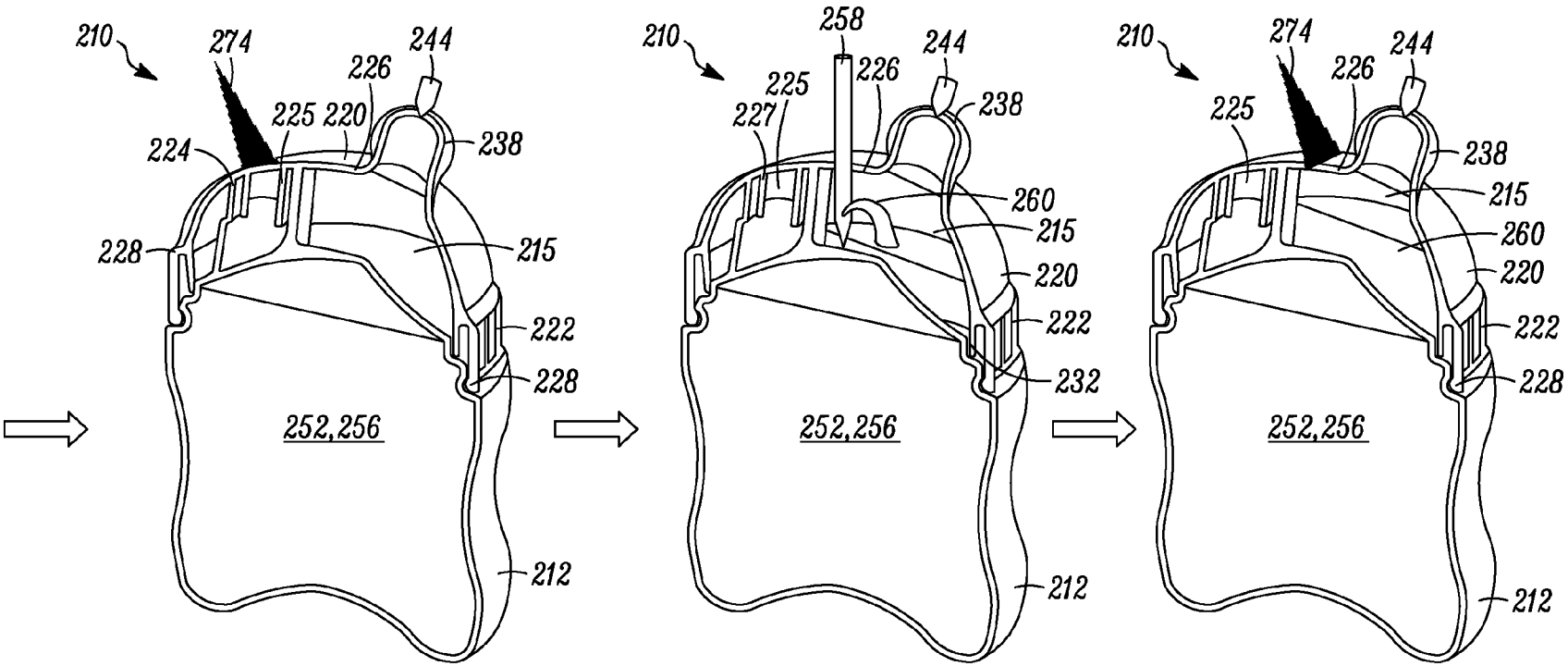

In FIGS. 8-14B another container embodying the present invention is indicated generally by the reference numeral 110. The container 110 is substantially similar to the container 10 described above with reference to FIGS. 1 through 7, and therefore like reference numerals preceded by the numeral "1" are used to indicate like elements. The primary difference of the container 110 in comparison to the container 10 is that the container closure and/or primary seal 124 further includes a penetrable and thermally resealable portion or stopper 125. Starting with a sealed empty container 110, and providing at least one filling or injection member 150 in fluid communication with at least one storage device containing at least one product stored therein (not shown), the container 110 is aseptically filled by penetrating the stopper 125 with the injection or filling member 150, such as a filling needle (FIGS. 15A-B). The product is then injected (FIG. 15C) through the filling member and into the chamber 114. Upon filling the container 110, the filling member 150 is removed and a resulting penetration hole in the stopper 125 is thermally resealed, such as by the application of laser energy 154 thereto (FIG. 16A), to seal the product within the container 110 (FIG. 16B) from the ambient atmosphere. The container 110 is then ready for shipping, storage and, ultimately, dispensing at the direction of the user. As shown in the illustrated embodiment, the primary seal 124 and/or stopper 125 and/or container closure 120 may include an optional annular injection member contacting surface 127 (FIG. 9) that contacts the injection or filling member 150 during withdrawal from the stopper 125 to substantially remove product thereon.

Figure 10B:
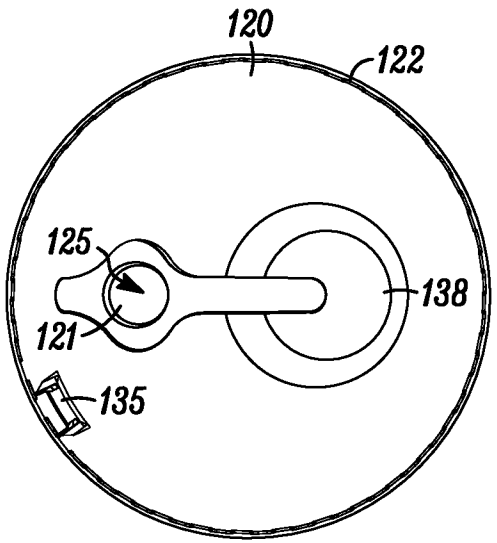
FIG. 10B is a top view of the container of FIG. 8.
Figure 10A:
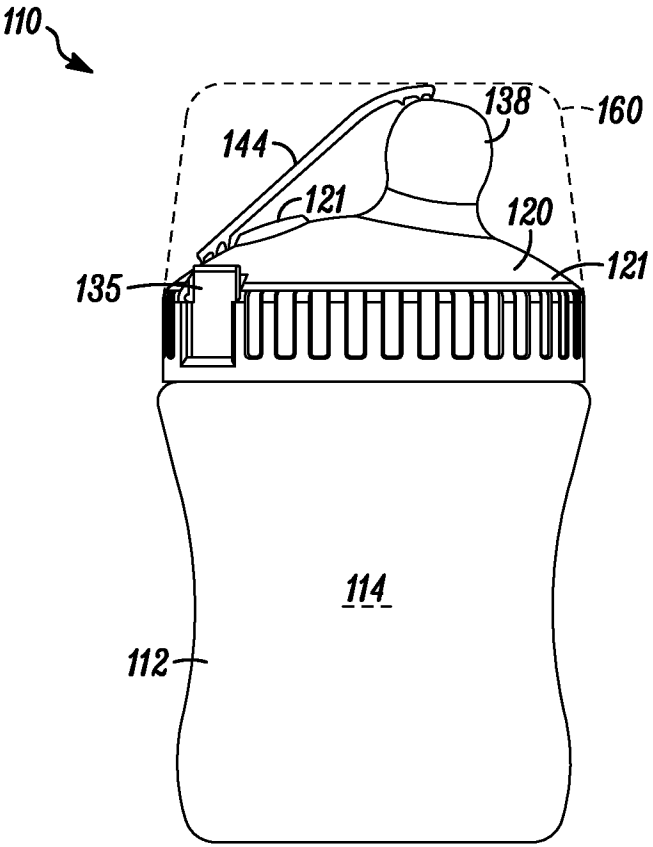
FIG. 10A is a side view of the container of FIG. 8.
Figure 12:
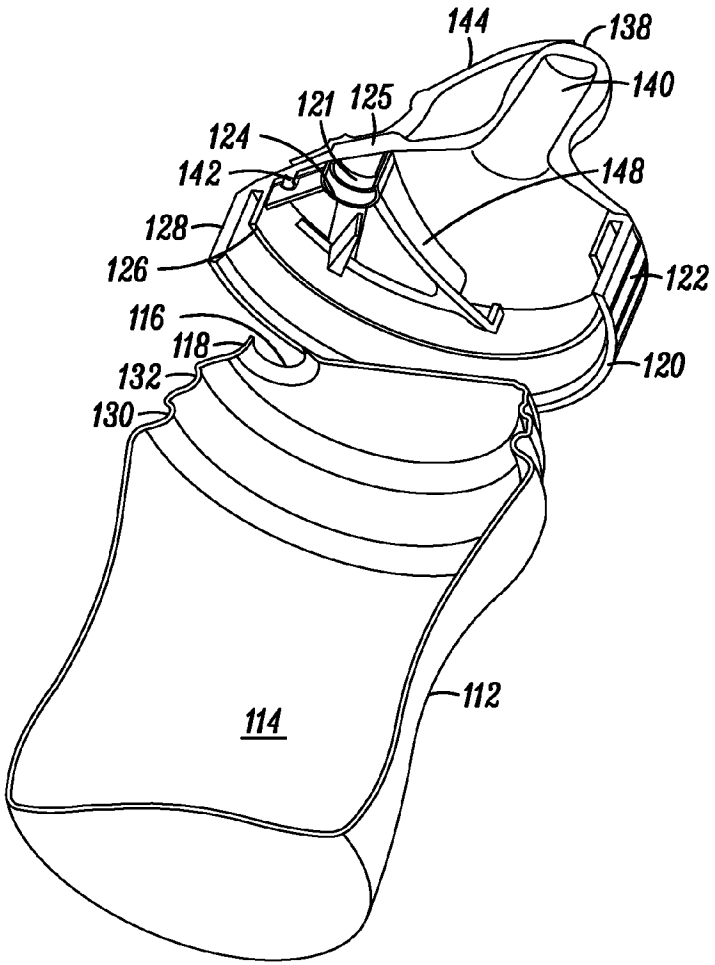
FIG. 12 is a side perspective cross-sectional view of the container of FIG. 8.
Figure 11:
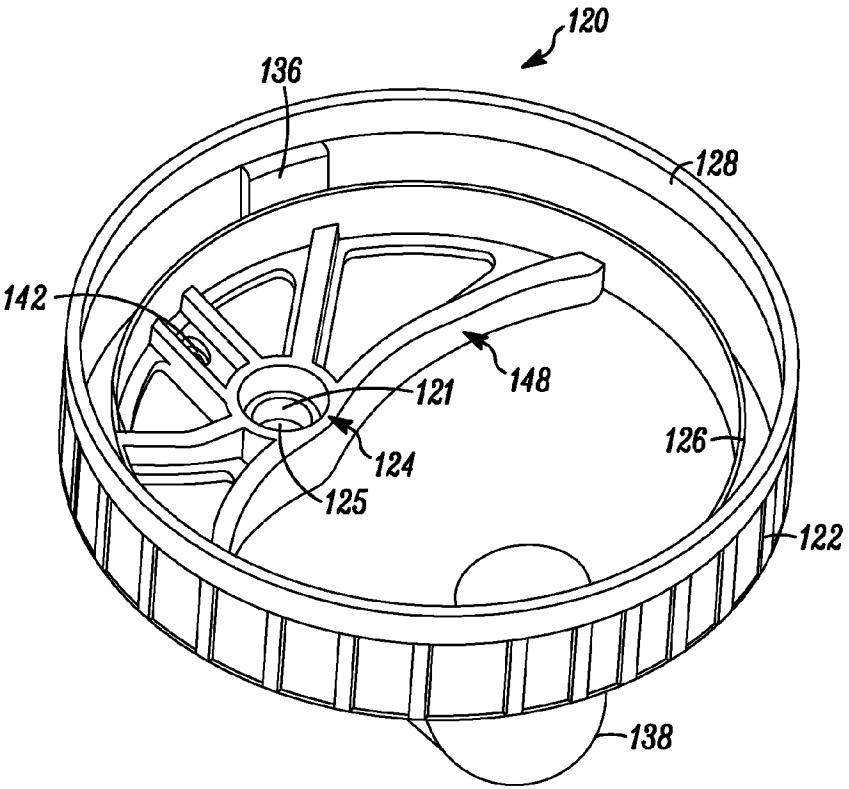
FIG. 11 is a bottom perspective view of the container closure of the container of FIG. 8.
Figure 13B:
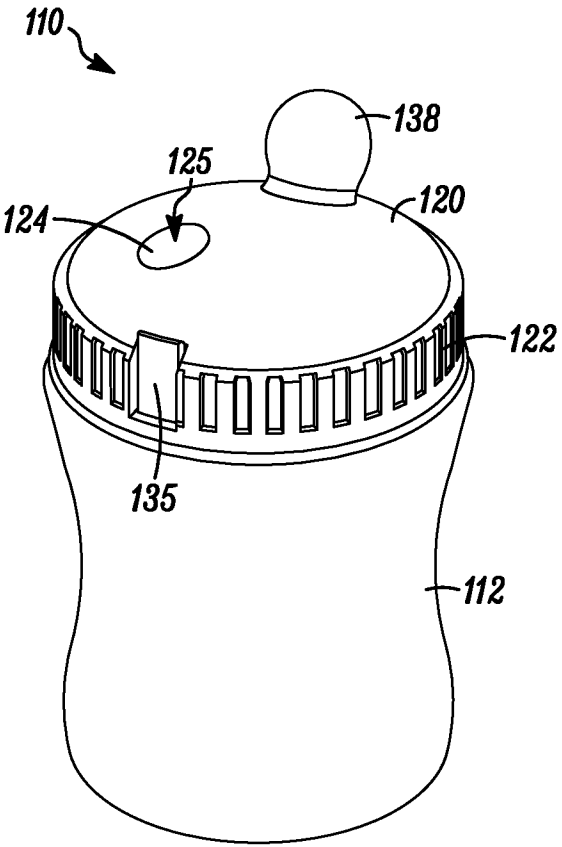
FIG. 13B is a top-side perspective view of the container of FIG. 8 with the sealing member removed.
Figure 13A:
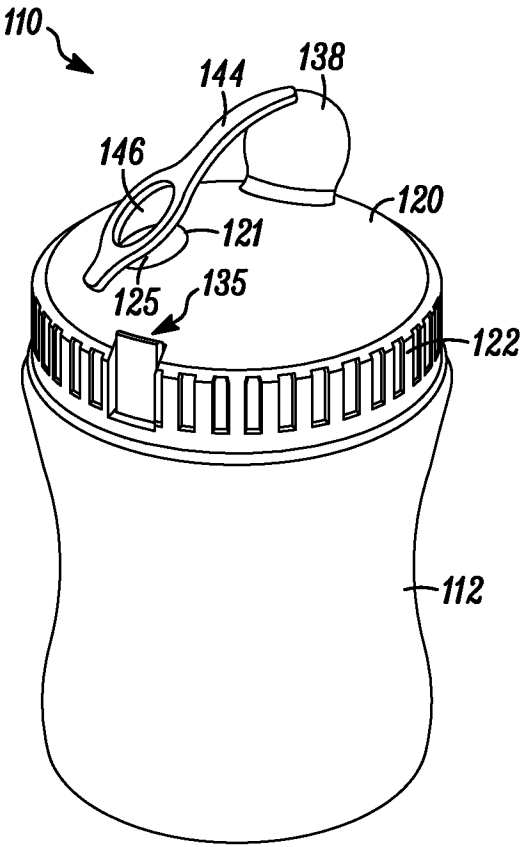
FIG. 13A is a top-side perspective view of the container of FIG. 8 with the sealing member attached.
Figure 14B:
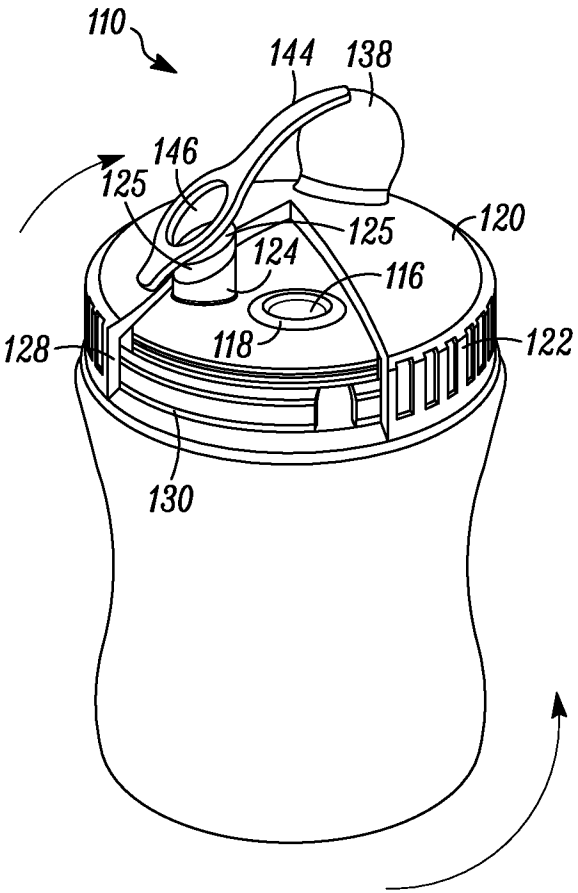
FIG. 14B is a side perspective view of the container of FIG. 8 with a portion of the container closure removed and showing the container closure in a second position.
Figure 14A:
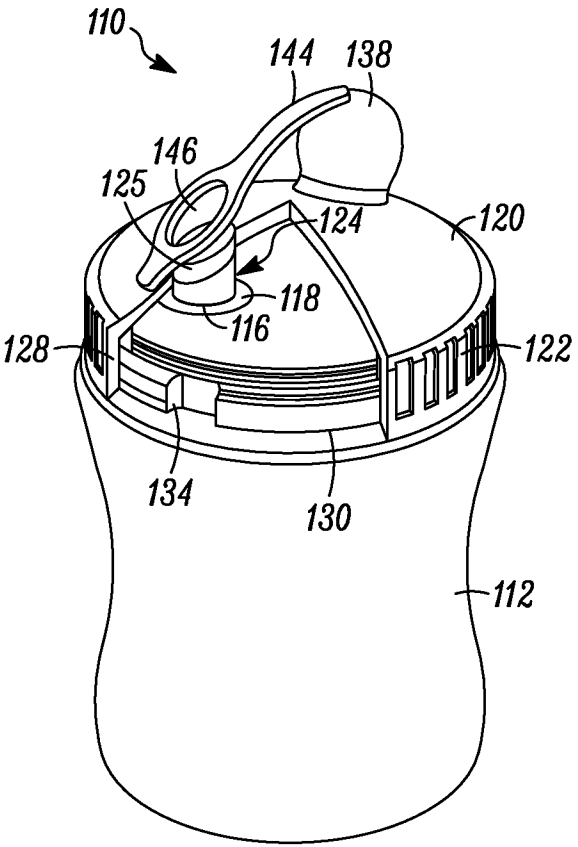
FIG. 14A is a side perspective view of the container of FIG. 8 with a portion of the container closure removed and showing the container closure in a first position.

In one embodiment of the container 110, the container includes an optional overcap 160 (shown in broken lines in FIG. 10A). The overcap 160 is attached mechanically or otherwise to at least one of the container closure 120 and container body 112. The overcap 160 provides an additional barrier to protect the container closure 120 and dispensing member 138 from contamination. The overcap 160 is designed to be removed by the consumer and may include a tear off strip or other mechanism (not shown) to indicate evidence of tampering. It should be noted that the overcap may also be used in conjunction with the container 10 described above and the container 210 described below.

Referring to FIGS. 17A-F, an example of a method of filling and resealing an embodiment of a container 210 of the present invention is shown. The container 210 is substantially similar to containers 10 and 110, and therefore like reference numerals preceded by the numeral "2" are used to indicate like elements. In the illustrated embodiment, the container 210 comprises two chambers 214, 215 and two resealable portions or stoppers, first stopper 225 and second stopper 226; however, it should be noted that in some embodiments, the container can comprise one or more chambers and one or more resealable portions or stoppers as desired. The first chamber 214 is defined within the container body 212 and the second chamber 215 is defined by a portion of the container body 212 in combination with a portion of the container closure 220; however, in an alternative embodiment, the second chamber 215 is wholly defined within the container closure 220.

The aseptic filling process starts with a sealed, empty container, defining one or more sealed, empty sterile chambers ready for aseptic filling therein of the product(s). The containers may be molded, such as by blow molding, so that the sealed, empty sterile chambers are created at the time of formation of sealed, empty container, in accordance with the teachings of the above-mentioned patent applications incorporated by reference herein. Alternatively, the sealed, empty containers may be sterilized such as by apply gamma or ebeam radiation thereon. Prior to filling, at least the external surfaces of the container that will contact the filling member are sterilized, such as by applying a fluid sterilant, such as VHP, or by applying radiation, such as ebeam radiation thereto. Alternatively, the sealed, empty sterile containers may be introduced into a sterile filling machine through a sterile transfer port. Then, starting with the container enclosure 220 assembled to container body 212 and the container 210 having at least two empty sterile sealed chambers 214, 215 (FIG. 17A), a filling member 250 is introduced into the first chamber 214 through the first stopper 225 and a resulting penetration aperture is created (not shown). In an alternative embodiment, a slit (not shown) is preformed in the stopper 225 for receiving the filling member. It should be noted that the penetration aperture and slit can take on numerous shapes and configurations that are currently known or that later become known. The filling member 250 is in fluid communication with a first liquid source (not shown) having a first liquid component 252. The first chamber 214 is then aseptically filled (FIG. 17B) with a desired volume of the first liquid component 252 and the first filling member 250 is removed therefrom. If desired, prior to filling the first chamber with the first liquid components, a purge may be performed by introducing an inert gas, such as nitrogen, into first chamber prior to aseptically filling the chamber with the product. The inert gas may be introduced with the same filling member as the liquid product, or may be introduced with a different filling member. Prior to introducing the inert gas, a vacuum may be drawn on the chamber through the filling member, if desired. Next, a second filling member 254 is introduced into the first chamber 214 through the aperture or slit. The second filling member 254 is in fluid communication with a second liquid source (not shown) having a second liquid component 256. The first chamber 214 is then aseptically filled (FIG. 17C) with a desired volume of the second liquid component 256 and, in turn, combined with the first liquid component to formulate a liquid product formulation within the sterile chamber 214 of the container 210. If desired, a purge likewise may be performed on the second chamber prior to filling. After the second filling member 254 is removed, the respective penetration aperture or slit in the resealable portion or stopper 225 is thermally resealed (FIG. 17D), such as by the application of laser energy 274 thereto, to hermetically seal the filled storage chamber 214 with respect to the ambient atmosphere. With the first chamber 214 filled and sealed, a third filling member 258 is introduced into the second chamber 215 through the second stopper 226 and a resulting penetration aperture is created (not shown). The third filling member 258 is in fluid communication with a third liquid source (not shown) having a third liquid component 260. The second chamber 215 is then aseptically filled (FIG. 17E) with a desired volume of the third liquid component 260. After the second chamber 215 is filled, the third filling member 258 is removed therefrom, and the penetration aperture or slit in the resealable portion or stopper 226 is thermally resealed (FIG. 17F), such as by the application of laser energy 274 thereto, to hermetically seal the filled storage chamber 215 with respect to the ambient atmosphere. After each fill, an inert gas may be pumped or otherwise released through the filling member prior to removing the filling member from the chamber to expel substantially all liquid through the filling member and into the chamber, and thereby prevent any dripping of liquid onto the container upon removal of the filling member therefrom. Alternatively, if, for example, a peristaltic pump is used to pump the liquid through the filling member, the pump can be reversed prior to withdrawing the filling member to create a suction or vacuum within the distal end of the filling member, and thereby prevent dripping of liquid therefrom and onto the container upon withdrawal of the filling member from the container.

When the product (i.e. liquid components) are ready for dispensing, the primary seal 224 is moved from the first position to the second as described above, thus opening the outflow port 16 and placing the first and second chambers 214 in fluid communication allowing the combination of liquid components to be dispensed through the outlet aperture 40.

In one embodiment of the present invention, the first liquid component 252 is a flavoring, such as vanilla, chocolate, coffee, fruit flavoring, a liquid sweetener, liquid vitamins and/or nutrients, combinations of these or any of numerous other flavorings, liquids, or additives that are currently known or that later become known; the second liquid 256 component is a base liquid, such as milk, baby formula, non-dairy milk substitutes, soy, water, fruit juice, cream, carbonated liquids, liquor, combinations of these or any of numerous other liquids that are currently known or that later become known; and the third liquid component 260 is a probiotic, vitamin or mineral supplement and/or medicament. The dispenser disclosed herein is particularly advantageous for storing and dispensing liquid nutrition products. For example, in some embodiments the liquid nutrition product, such as an infant formula or a growing up milk, is aseptically filled into the first chamber 214, and an additive, such as a dietary or nutritional supplement, such as a probiotic, is filled into the second chamber 215. In some embodiments, the liquid nutrition or other product is filled by filling in series a plurality of product components or ingredients into the same chamber, such as one fill with heat sterilized components, and another fill with cold sterilized components, as disclosed, for example, in the following co-pending patent applications that are hereby incorporated by reference in their entireties as part of the present disclosure: U.S. Application Ser. No. 60/997,675, filed Oct. 4, 2007, entitled "Apparatus and Method for Formulating and Aseptically Filling Liquid Products", U.S. application Ser. No. 12/245,678, filed Oct. 3, 2008, entitled "Apparatus for Formulating and Aseptically Filling Liquid Products" and U.S. application Ser. No. 12/245,681, filed Oct. 3, 2008, entitled "Method for Formulating and Aseptically Filling Liquid Products". One of the advantages of having multiple chambers that are sealed from the ambient atmosphere and from each other is that the liquid components and/or substances in each chamber can be stored as required to best preserve quality, integrity and freshness. For example, probiotics and other substances best maintained in an oil base such as, for example, a food grade oil, can be stored in one chamber, while substances best maintained in a non-oil base, such as, for example, in a water base, can be stored in another chamber. In this manner, the substance(s) in each chamber only interact when the primary seal is displaced from the outlet port, which occurs, for example, when the container closure 20 is moved from the first position to the second position just prior to ingestion/consumption to avoid premature spoilage or a degradation in quality and freshness or, in the case of probiotics, avoid destroying the active ingredients.

It should be known that the filling method described above can include an infinite number of liquid sources, liquid components and respective filling members, and the containers can be filled with any one liquid component, any combination of selected liquid components or, if desired, all available liquid components, in any available chamber and in any order.

The sterile, empty container and closure assemblies 10 may be filled and thermally resealed in accordance with the teachings of any of the following patent applications and patents that are hereby incorporated by reference in their entireties as part of the present disclosure: U.S. Provisional Patent Application Ser. No. 60/981,107, filed Oct. 19, 2007, entitled "Container Having a Closure and Removable Resealable Stopper for Sealing a Substance Therein and Related Method," U.S. patent application Ser. No. 12/245,678, filed Oct. 3, 2008, entitled "Apparatus for Formulating and Aseptically Filling Liquid Products" and U.S. patent application Ser. No. 12/245,681, filed Oct. 3, 2008, entitled "Method for Formulating and Aseptically Filling Liquid Products," which claim the benefit of U.S. Provisional Patent Application Ser. No. 60/997,675, filed Oct. 4, 2007, entitled "Apparatus and Method for Formulating and Aseptically Filling Liquid Products," U.S. patent application Ser. No. 11/339,966, filed Jan. 25, 2006, entitled "Container closure with Overlying Needle Penetrable and Thermally Resealable Portion and Underlying Portion Compatible with Fat Containing Liquid Product, and Related Method," U.S. patent application Ser. No. 11/879,485, filed Jul. 16, 2007, entitled "Device with Needle Penetrable and Laser Resealable Method, and Related Portion," which is a continuation of similarly titled U.S. patent application Ser. No. 11/408,704, now U.S. Pat. No. 7,243,689, issued Jul. 17, 2007, which is continuation of U.S. patent application Ser. No. 10/766,172 filed Jan. 28, 2004, entitled "Medicament Vial Having A Heat-Sealable Cap, And Apparatus and Method For Filling The Vial", now U.S. Pat. No. 7,132,631, issued Apr. 25, 2006, which is a continuation-in-part of similarly titled U.S. patent application Ser. No. 10/694,364, filed Oct. 27, 2003, now U.S. Pat. No. 6,805,170, issued Oct. 19, 2004, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same," U.S. patent application Ser. No. 10/983,178, filed Nov. 5, 2004, entitled "Adjustable Needle Filling and Laser Sealing Apparatus and Method; U.S. patent application Ser. No. 11/901,467, filed Sep. 17, 2007, entitled "Apparatus and Method for Needle Filling and Laser Resealing", which is a continuation of similarly titled U.S. patent application Ser. No. 11,510,961, filed Aug. 28, 2006, now U.S. Pat. No. 7,270,158 issued Sep. 18, 2007, which is a continuation of similarly titled U.S. patent application Ser. No. 11/070,440, filed Mar. 2, 2005, now U.S. Pat. No. 7,096,896, issued Aug. 29, 2006, U.S. patent application Ser. No. 11/074,513 filed Mar. 7, 2005, entitled "Apparatus for Molding and Assembling Containers with Stoppers and Filling Same," and U.S. patent application Ser. No. 11/074,454, filed Mar. 7, 2005, entitled "Method for Molding and Assembling Containers with Stoppers and Filling Same," U.S. patent application Ser. No. 11/786,206, filed Apr. 10, 2007, entitled "Ready to Drink Container with Nipple and Needle Penetrable and Laser Resealable Portion, and Related Method"; and U.S. application Ser. No. 11/804,431, filed May 18, 2007, entitled "Delivery Device with Separate Chambers Connectable in Fluid Communication When Ready for Use, and Related Method".

In the illustrated embodiment of the invention, the needle penetrable and thermally resealable portions or stoppers 125, 225, 226 are preferably made of a thermoplastic/elastomer blend, and may be the same material as those described in the co-pending patent applications and/or patents incorporated by reference above. Accordingly, in one such embodiment, the penetrable and thermally resealable portion or stopper is a thermoplastic elastomer that is heat resealable to hermetically seal the needle aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of radiation through the predetermined wall thickness thereof, and (iii) a predetermined color and opacity that causes the laser radiation at the predetermined wavelength and power to hermetically seal the needle aperture formed in the needle penetration region thereof in a predetermined time period of less than or equal to about 5 seconds and substantially without burning the needle penetration region.

In one embodiment, the penetrable and thermally resealable portion or stopper is a thermoplastic elastomer that is heat resealable to hermetically seal the needle aperture by applying laser radiation at a predetermined wavelength and power thereto, and includes (i) a styrene block copolymer; (ii)

an olefin; (iii) a predetermined amount of pigment that allows the penetrable and thermally resealable portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and the penetrable and thermally resealable portion or stopper portion during needle penetration thereof. In one such embodiment, the penetrable and thermally resealable portion or stopper includes less than or equal to about 40% by weight styrene block copolymer, less than or equal to about 15% by weight olefin, less than or equal to about 60% by weight mineral oil, and less than or equal to about 3% by weight pigment and any processing additives of a type known to those of ordinary skill in the pertinent art. The term "pigment" is used herein to mean any of numerous different substances or molecular arrangements that enable the material or material portion within which the substance or molecular arrangement is located to substantially absorb laser radiation at the predetermined wavelength and, in turn, transform the absorbed energy into heat to melt the respective material forming the penetrable and thermally resealable portion or stopper and resealing an aperture formed therein.

In one embodiment, the penetrable and thermally resealable portion or stopper is a thermoplastic elastomer that is heat resealable to hermetically seal the needle aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the penetrable and thermally resealable portion or stopper to substantially absorb laser radiation at the predetermined wavelength and substantially prevent the passage of radiation through the predetermined wall thickness thereof, and hermetically seal a needle aperture formed in the needle penetration region thereof in a predetermined time period of less than or equal to about 5 seconds; and (iv) a lubricant in an amount that reduces friction forces at an interface of the needle and second material portion during needle penetration thereof.

In one embodiment of the invention, the pigment is sold under the brand name Lumogen™ IR 788 by BASF Aktiengesellschaft of Ludwigshafen, Germany. The Lumogen IR products are highly transparent selective near infrared absorbers designed for absorption of radiation from semiconductor lasers with wavelengths near about 800 nm. In this embodiment, the Lumogen pigment is added to the elastomeric blend in an amount sufficient to convert the radiation to heat, and melt the stopper material, preferably to a depth equal to at least about ⅓ to about ½ of the depth of the needle hole, within a time period of less than or equal to about 5 seconds, preferably less than about 3 seconds, and most preferably less than about 1½ seconds. The Lumogen IR 788 pigment is highly absorbent at about 788 nm, and therefore in connection with this embodiment, the laser preferably transmits radiation at about 788 nm (or about 800 nm). One advantage of the Lumogen IR 788 pigment is that very small amounts of this pigment can be added to the elastomeric blend to achieve laser resealing within the time periods and at the resealing depths required or otherwise desired, and therefore, if desired, the needle penetrable and laser resealable stopper may be transparent or substantially transparent. This may be a significant aesthetic advantage. In one embodiment of the invention, the Lumogen IR 788 pigment is added to the elastomeric blend in a concentration of less than about 150 ppm, is preferably within the range of about 10 ppm to about 100 ppm, and most preferably is within the range of about 20 ppm to about 80 ppm. In this embodiment, the power level of the 800 nm laser is preferably less than about 30 Watts, or within the range of about 8 Watts to about 18 Watts.

In one embodiment of the present invention, the substance or product contained within the storage chamber is a fat containing liquid product, such as infant or baby formula, and the primary seal and the penetrable and thermally resealable portion or stopper, first container closure member, any other components of the container closure that is exposed to potential direct contact with the product stored within the chamber, and the body each are selected from materials (i) that are regulatory approved for use in connection with nutritional foods, and preferably are regulatory approved at least for indirect contact, and preferably for direct contact with nutritional foods, (ii) that do not leach an undesirable level of contaminants or non-regulatory approved leachables into the fat containing product, such mineral oil, and (iii) that do not undesirably alter the taste profile (including no undesirable aroma impact) of the fat containing liquid product to be stored in the container.

In the embodiment of the present invention wherein the product is a fat containing liquid nutrition product, such as an infant or baby formula, exemplary materials for the penetrable and thermally resealable portion or stopper are selected from the group including GLS 254-071, GLS LC254-071, GLS LC287-161, GLS LC287-162, C-Flex R70-001, C-Flex R70-005+about 62.5 ppm Lumogen, C-Flex R70-005+about 75 ppm Lumogen, Evoprene TS 2525 4213, Evoprene SG 948 4213, Evoprene G968-4179+about 0.026% Carbon Black, Evoprene G968-4179+about 62.5 ppm Lumogen and Cawiton 7193, modifications of any of the foregoing, or similar thermoplastic elastomers. In one such embodiment, the body is an injection molded multi-layer of PP/EVOH. In another such embodiment, the body is blow molded, such as by extrusion blow molding, and is an HDPE/EVOH multi layer.

As may be recognized by those skilled in the pertinent art based on the teachings herein, numerous changes and modifications may be made to the above-described and other embodiments of the present invention without departing from its scope as defined in the appended claims. For example, the first and/or second chamber of the container can be filled with any desired substance such as, for example, a liquid product, an additive, a probiotic or combinations thereof, by any of numerous sterile filling methods that are currently known, or that later become known, and without forming and/or resealing a filling member aperture in one or both of the resealable portions, while maintaining the stored substances in the respective chambers separate (if desired) until mixing and dispensing occurs. Additionally, the nipple, seals and other components of the container closure may be made of any of numerous different materials that are currently known, or that later become known for performing their functions and/or depending on the container application(s), including the product to be stored within the container. For example, the nipple or teat may take any of numerous different configurations of nipples, and may be formed of any of numerous different nipple materials, that are currently known, or that later become known. As a further example, the penetrable and thermally resealable material may be blended with any of numerous different materials to obtain any of numerous different performance objectives. For example, any of the thermoplastic elastomers described above may be blended with, for example, small beads of glass or other insert beads or particles to enhance absorption of the laser radiation and/or to reduce or eliminate the formation of particles when needle penetrated. In addition, the body and container closure may take any of numerous different shapes and/or configurations, and may be adapted to receive and store within the storage chamber any of numerous different substances or products that are currently known or that later become known, including without limitation, any of numerous different food or beverage products, including low acid or fat containing liquid products, such as milk-based products, including without limitation milk, evaporated milk, infant formula, growing-up milks, condensed milk, cream, half-and-half, yogurt, and ice cream (including dairy and non-diary, such as soy-based ice cream), other liquid nutrition products, liquid healthcare products, juice, syrup, coffee, condiments, such as ketchup, mustard, and mayonnaise, and soup, and pharmaceutical products. The term "liquid nutrition product" is used herein to mean enterally ingested liquids that are formulated primarily for meeting one or more specific nutritional requirements of, and that contribute to the energy requirements of, a person that ingests the liquid. Liquid nutrition products do not include, for example, foods and beverages that are administered other than enterally, such as parenteral or injectable liquids, pharmaceutical, dermatological, cosmetic, ophthalmic and veterinary products and preparations, vaccines, and dietary and nutritional supplements without sufficient calorific value to contribute to the energy requirements of a person that ingests the liquid. The term "food and beverage products" are used herein to mean food and beverages that are orally ingested by humans, but does not include liquid nutrition products, foods and beverages that are administered other than orally, such as by injection, pharmaceutical, dermatological, cosmetic, ophthalmic and veterinary products and preparations, vaccines, and dietary and nutritional supplements. In addition, although described with reference to liquid products herein, the containers and filling apparatus and methods equally may be employed with gaseous, powdered, and semi-solid products. Accordingly, this detailed description of preferred embodiments is to be taken in an illustrative, as opposed to a limiting sense.

What is claimed is:

1. A container for storing and dispensing a product, the container comprising:

a body defining a chamber for storing the product and an outflow port in fluid communication with the chamber;

a container closure including:

a primary seal in fixed relation to at least part of the container closure, and a dispensing member defining an outlet aperture placeable in fluid communication with the outflow port, wherein at least one of the container closure and body is movable relative to the other between a first position where the primary seal is at least one of seated about and overlies the outflow port to hermetically seal the product in the chamber, and a second position where the primary seal is displaced from the outflow port to allow the product to pass from the chamber through the outflow port and into the outlet aperture of the dispensing member to dispense the product; and further comprising a secondary seal forming a substantially fluid-tight seal between the container closure and the body.

2. A container as defined in claim 1, further including at least one additional chamber, the at least one additional chamber located in at least one of (i) the body of the container, (ii) the container closure and (ii) a combination of the body of the container and container closure, and is in fluid communication with the chamber when the primary seal is in the second position, wherein the chamber stores a first substance, the at least one additional chamber stores at least one additional substance, the first substance and the at least one additional substance forming the dispensed product.

3. A container as defined in claim 1, further comprising an elastomeric portion that is penetrable by an injection or filling member, and a resulting injection aperture is resealable.

4. A container as defined in claim 1, wherein the primary seal is penetrable by an injection member for aseptically filling the chamber with the product through the injection member, and is resealable to seal the product within the chamber.

5. A container as defined in claim 1, wherein the container closure further comprises a vent aperture for improving the flow of product between the chamber and outlet aperture when the container closure is in the second position.

6. A container as defined in claim 5, further comprising a sealing member that is movable between a first position sealing at least one of (i) the outlet aperture, (ii) the vent aperture and (iii) the outlet aperture and the vent aperture, and a second position opening at least one of (i) the outlet aperture, (ii) the vent aperture and (iii) the outlet aperture and the vent aperture.

7. A container as defined in claim 6, wherein the sealing member is frangibly connected to at least one of the dispensing member and container closure in the first position, and the sealing member is disconnected from the at least one of the dispensing member and container closure in the second position.

8. A container as defined in claim 1, wherein the dispensing member is a nipple.

9. A container as defined in claim 8, wherein the nipple includes a stem portion and a tip portion, the outlet aperture extending through the stem portion and tip portion.

10. A container as defined in claim 9, wherein the nipple is at least one of a round nipple, a bi-stable nipple and a stretchable nipple.

11. A container as defined in claim 9, wherein the container closure has an outer convexed surface, and the nipple extends outwardly from the outer convexed surface.

12. A container as defined in claim 11, wherein the outer convexed surface in combination with the nipple replicate the shape and feel of a female breast.

13. A container as defined in claim 1, wherein the container closure rotates between the first position and the second position about a longitudinal axis of the container.

14. A container as defined in claim 1, further comprising a frangible member having an engaging position where the frangible member engages a portion of the container closure and body after the container is filled with the product to prevent the container closure from moving out of the first position, and a disengaging position where the frangible member is removed from the container to allow the container closure to be moved between the first and second positions.

15. A container as defined in claim 1, wherein the dispensing member is at least one of (i) a drinking spout, (ii) a drinking spout including a one-way check valve, wherein the check valve opens under negative pressure to allow the product to exit the outlet aperture, and (iii) a push-pull cap, wherein the outlet aperture is closed when the cap is in the retracted push position and the outlet aperture is open when the cap is in the extended pull position.

16. A container as defined in claim 1, wherein the chamber is adapted for storing a fat containing liquid product; the body, primary seal and dispensing member do not leach more than a predetermined amount of leachables into the fat containing liquid product and do not undesirably alter a taste profile of the fat containing liquid product; and the predetermined amount of leachables is less than about 100 PPM.

17. A container as defined in claim 1, wherein the container closure further includes a securing portion connectable to the body for securing the container closure to the body.

18. A container as defined in claim 17, wherein the securing portion is snap-fit to the body.

19. A container as defined in claim 1, wherein the body is made from a blow molded polymer.

20. A container as defined in claim 1, wherein the primary seal is a thermoplastic elastomer that is heat resealable to hermetically seal a penetration aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of radiation through the predetermined wall thickness thereof, and (iii) a predetermined color and opacity that causes the laser radiation at the predetermined wavelength and power to hermetically seal the penetration aperture in a predetermined time period of less than or equal to about 5 seconds and substantially without burning the primary seal.

21. A container as defined in claim 3, wherein the primary seal is a thermoplastic elastomer that is heat resealable to hermetically seal a penetration aperture by applying laser radiation at a predetermined wavelength and power thereto, and includes (i) a styrene block copolymer; (ii) an olefin; (iii) a predetermined amount of pigment that allows the primary seal to substantially absorb laser radiation at the predetermined wavelength and substantially prevent the passage of radiation through the predetermined wall thickness thereof, and hermetically seal the penetration aperture in a predetermined time period of less than or equal to about 5 seconds; and (iv) a predetermined amount of lubricant that reduces friction forces at an interface of the injection or filling member and primary seal during penetration thereof.

22. An assembly comprising a container as defined in claim 1; a filling apparatus comprising a manifold including a plurality of injection or filling members spaced relative to each other and movable relative to a container support for penetrating a plurality of containers mounted on the support within the filling apparatus, filling the containers through the injection or filling members, and withdrawing the injection or filling members from the filled containers; and a plurality of assemblies, wherein each assembly is connectable to a source of radiation or energy, and is focused substantially on a penetration spot on a penetrable and resealable portion of a respective container closure for applying radiation or energy thereto and resealing a respective penetration aperture therein formed by the injection or filling member.

23. An assembly as recited in claim 22, further comprising:

a housing defining an inlet end, an outlet end, and a sterile zone between the inlet and outlet ends;

a conveyor located at least partially within the sterile zone and defining a plurality of container positions thereon for supporting and moving containers in a direction from the inlet end toward the outlet end through the sterile zone;

a fluid sterilant station located within the sterile zone and coupled in fluid communication with a source of fluid sterilant for transmitting fluid sterilant onto the container closure of a respective container supported on the conveyor within the fluid sterilant station and sterilizing an exposed penetrable and thermally resealable portion of the respective container closure; and at least one sterilant removing station located within the sterile zone between the fluid sterilant station and the outlet end of the housing, and coupled in fluid communication with a source of gas for transmitting the gas onto a container supported on the conveyor within the at least one sterilant removing station to flush away fluid sterilant on the container;

wherein the manifold and assemblies are located within the sterile zone between the at least one sterilant removing station and the outlet end of the housing for receiving the sterilized containers therefrom.

24. An assembly as defined in claim 22, wherein the fluid sterilant is hydrogen peroxide.

25. An assembly as defined in claim 22, further comprising a source of sterile gas coupled in fluid communication with the sterile zone for creating an over pressure of sterile gas within the sterile zone, and means for directing a flow of the sterile gas substantially in a direction from the outlet end toward the inlet end of the housing to thereby prevent fluid sterilant from flowing onto containers located adjacent to the manifold.

26. A container as defined in claim 8, wherein the container closure defines a central region and the nipple is laterally spaced relative to the central region.

27. A container for storing a product comprising:

first means for providing a chamber for receiving the product; and second means for closing the chamber of the first means; third means for forming a substantially fluid-tight seal between the first means and the second means, fourth means for insertion into a user's mouth and drawing the product from the chamber therethrough, and fifth means for hermetically sealing the product in the chamber, wherein the first means and the second means are moveable relative to each other between a first position and a second position where the fifth means is displaced from its hermetic sealing during the movement from the first position to the second position; and the fifth means is in fixed relation to at least part of the second means.

28. A container as defined in claim 27, further comprising sixth means for allowing penetration of the second means by an injection or filling member for aseptically filling the chamber with the product through the injection member, and for allowing resealing of the second means to seal the product within the chamber.

29. A container as defined in claim 27, wherein the first means is a container body, the second means is a container closure, the third means is a sealing member, the fourth means is a nipple, and the fifth means is a sealing member that is movable between a first position to hermetically seal the product in the chamber and a second position to allow the product to flow out of the chamber and into the nipple for dispensing.

30. A container as defined in claim 28, wherein the sixth means is a penetrable and resealable elastomeric portion that is penetrable by the injection member for aseptically filling the chamber with the product through the injection member, and that is resealable to seal the product within the chamber by the application of radiation or energy thereto.

31. A container as defined in claim 1, further including a removable overcap attached to at least one of the container closure and body.

32. A container as defined in claim 3, wherein the elastomeric portion is thermally resealable.

33. A container as defined in claim 4, wherein the primary seal is thermally resealable.

34. A container as defined in claim 30, wherein the elastomeric portion is thermally resealable by the application of laser radiation or energy thereto.

35. An assembly as defined in claim 22, wherein said assemblies are laser optic assemblies connectible to a source of laser radiation.

36. An assembly as defined in claim 22, wherein said source is one of a source of laser radiation and a source of thermal energy.

37. An assembly as defined in claim 22, wherein the injection or filling members comprise needles.

38. A container as defined in claim 5, wherein the dispensing member is eccentrically mounted on the container closure and defines an axis of symmetry that is oriented at an acute angle relative to an elongated axis of the body, and wherein the vent aperture is laterally spaced from the dispensing member on an approximately opposite side of the container closure relative to the dispensing member.

39. A container as defined in claim 1, further comprising a sealing member, movable between a first position, sealing the outlet aperture, and a second position, opening the outlet aperture.

40. A container as defined in claim 39, the sealing member is frangibly connected to at least one of the dispensing member and container closure in the first position, and the sealing member is disconnected from the at least one of the dispensing member and container closure in the second position.

41. A container as defined in claim 1, wherein when the container closure or body is moved relative to the other, the secondary seal maintains the substantially fluid-tight seal between the container closure and the body.

42. A container as defined in claim 1, wherein the primary seal comprises a sealing surface, and during movement of the container closure or the body, both the sealing surface and the primary seal are moved relative to the outflow port.

43. A container as defined in claim 1, wherein the primary seal defines an axis therethrough and the outflow port defines an axis therethrough, and wherein, in the first position the axis of the primary seal and the axis of the outflow port are substantially aligned, and in the second position the axis of the primary seal and the axis of the outflow port are substantially not aligned.

44. A container as defined in claim 1, wherein, when the closure is moved from the first position to the second position, the secondary seal moves relative to the body while maintaining maintains the substantially fluid-tight seal between the container closure and the body.

45. A container as defined in claim 1, wherein the container defines a longitudinal axis extending therethrough and wherein the primary seal rotates about the longitudinal axis of the container when the closure is moved from the first position to the second position.

46. A container as defined in claim 1, wherein the body defines a surface overlying the chamber defining a majority of surface area between the chamber and the container closure, and the outflow port defines a substantially lesser surface area than said surface.

47. A container as defined in claim 1, wherein the body defines a longitudinal axis extending therethrough and wherein the outflow port is offset from the longitudinal axis of the body.

48. A container as defined in claim 1, wherein the primary seal forms an interference fit with the outflow port.

49. A container as defined in claim 1, wherein the primary seal defines an internal surface in fluid communication with the chamber and forms at least most of the surface area of the container closure that can contact any product within the chamber in the first position.

* * * * *